US008157608B1

(12) United States Patent
Stapleton

(10) Patent No.: US 8,157,608 B1
(45) Date of Patent: Apr. 17, 2012

(54) ONE-PIECE POLYHEDRAL CONSTRUCTION MODULES

(76) Inventor: Jonathan Walker Stapleton, Essex, VT (US)

( * ) Notice: Subject to any disclaimer, the term of this patent is extended or adjusted under 35 U.S.C. 154(b) by 0 days.

(21) Appl. No.: 12/661,322

(22) Filed: Mar. 15, 2010

Related U.S. Application Data

(63) Continuation of application No. 11/837,518, filed on Aug. 12, 2007, now abandoned.

(60) Provisional application No. 60/837,058, filed on Aug. 12, 2006.

(51) Int. Cl.
*A63H 33/08* (2006.01)

(52) U.S. Cl. ..... 446/124; 446/75; 446/108; 446/114; 446/115; 446/120; 446/125; 273/153 R; 273/153 P; 273/157 R

(58) Field of Classification Search ..... 446/75, 446/108, 114, 115, 120, 124, 125; 273/153 R, 273/153 P, 157 R
See application file for complete search history.

(56) References Cited

U.S. PATENT DOCUMENTS 3,005,282 A * 10/1961 Christiansen ..... 446/128
3,461,574 A * 8/1969 Larsen et al. ..... 434/403
3,645,535 A * 2/1972 Randolph ..... 273/157 R
4,207,715 A * 6/1980 Kitrick ..... 52/81.4
4,238,905 A * 12/1980 MacGraw, II ..... 446/92
4,723,382 A * 2/1988 Lalvani ..... 52/81.1
4,736,550 A * 4/1988 Hawranick ..... 52/574
5,098,328 A * 3/1992 Beerens ..... 446/128
5,168,677 A * 12/1992 Pronsato et al. ..... 52/81.1
D359,315 S * 6/1995 Tacey ..... D21/499
5,501,626 A * 3/1996 Harvey ..... 446/104
5,567,194 A * 10/1996 Stapleton ..... 446/124
5,762,529 A * 6/1998 Nizza ..... 446/85
6,076,318 A * 6/2000 Grimm et al. ..... 52/245
6,152,797 A * 11/2000 David ..... 446/115
6,186,856 B1 * 2/2001 Chen ..... 446/128
6,264,199 B1 * 7/2001 Schaedel ..... 273/157 R
6,379,212 B1 * 4/2002 Miller ..... 446/85
6,386,936 B1 * 5/2002 Gebara ..... 446/117
6,439,571 B1 * 8/2002 Wilson ..... 273/157 R
6,648,715 B2 * 11/2003 Wiens et al. ..... 446/121
6,921,314 B2 * 7/2005 Miller ..... 446/85
7,152,381 B2 * 12/2006 Hasley ..... 52/561
7,247,075 B2 * 7/2007 von Oech ..... 446/92
7,905,757 B1 * 3/2011 Stapleton ..... 446/85

* cited by examiner

*Primary Examiner* — Gene Kim
*Assistant Examiner* — Alexander Niconovich

(57) ABSTRACT

One piece, injection-moldable, functionally polyhedral construction modules. The construction modules are thin-walled, cored out versions of a polyhedron. Each construction module comprises one polyhedron wall portion that is interiorly tangent to each face of at least one set of identical faces of a superimposed polyhedron template. Each polyhedron wall portion forms a complex with its tangent face of its superimposed polyhedron template that is the mirror image of at least half of such complexes. Each polyhedron wall portion is visible in both directions along a predetermined axis. Each polyhedron wall portion comprises an asymmetric aligning means that may include one or more snap-fit connectors. Every polyhedron wall portion is part of a single piece of material. Accordingly, these construction modules may be injection molded as single pieces of material, and, when they are aligned face-to-face, they exhibit the constructive properties of their polyhedron templates.

8 Claims, 23 Drawing Sheets

Fig. 8B
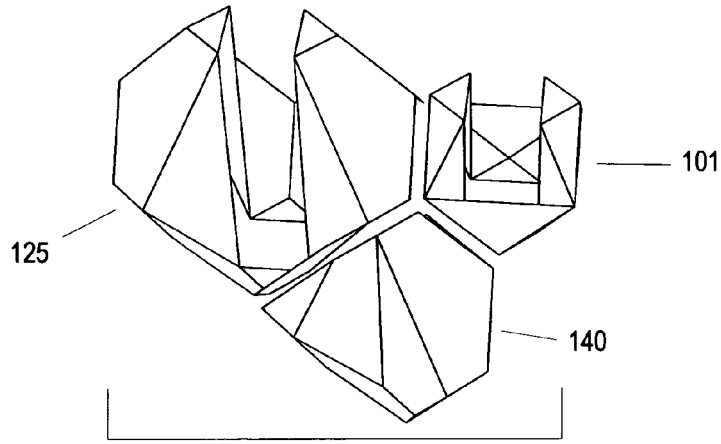
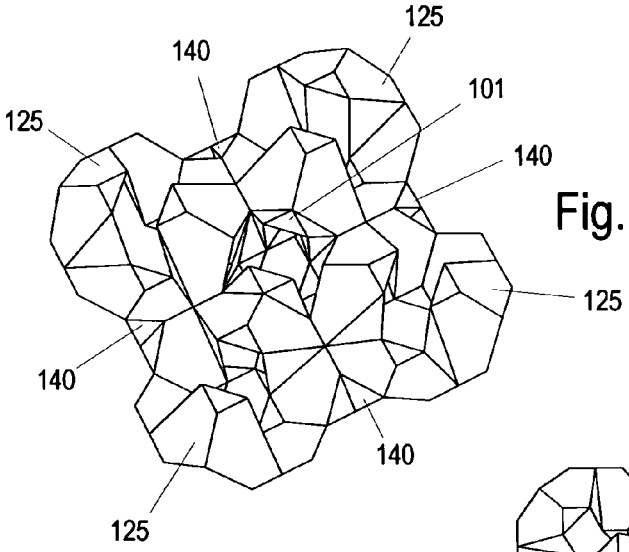
Fig. 8C
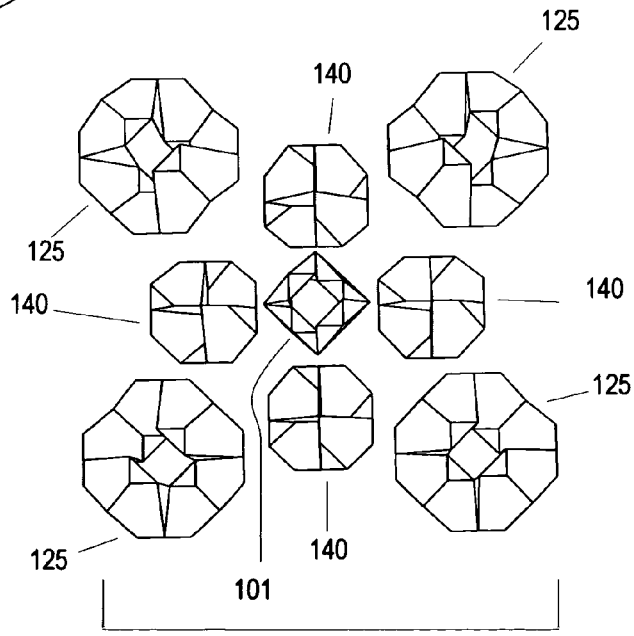
Fig. 8D

ONE-PIECE POLYHEDRAL CONSTRUCTION MODULES

CROSS-REFERENCE TO RELATED APPLICATIONS

This application claims the benefit of provisional patent application Ser. No. 60/837,058, filed 2006 Aug. 12 by the present inventor.

This is a continuation of application Ser. No. 11/837,518, filed Aug. 12, 2007, now abandoned.

FEDERALLY SPONSORED RESEARCH

Not Applicable

SEQUENCE LISTING OR PROGRAM

Not Applicable

BACKGROUND OF THE INVENTION

1. Field of the Invention

This invention relates to construction modules, specifically to releasably connectable modules that exhibit the construction properties of polyhedra and can be easily injection molded as single pieces of plastic.

2. Prior Art

"Box Shaped" Construction Modules

Many space-filling cube and brick-shaped polyhedral modules are known in the prior art. The major advantage of these modules is that they can be molded as one piece of plastic and are, therefore, economical to manufacture. However, these brick-type construction blocks are typically severely limited in terms of which of their six faces can mate with one of the six faces of another, identical, block. Four of their "side" walls are usually sheer, while their top and bottom surfaces incorporate either studs or recesses (as shown in Christiansen's U.S. Pat. No. 3,005,282—Oct. 24, 1961). In most cases, out of six possible faces of such a brick, there is only one other compatible brick face that can mate with any given mating surface.

Having a limited number of compatible mating surfaces on each module is disadvantageous for at least two reasons. First, it complicates construction; the "next block" cannot simply be added on in any direction. Second, it limits accessories that might be added to a structure. For example, if one wanted to attach a snap-on eye, arm, or nose, there are a very limited number of available surfaces for such attachments.

There are examples of one-piece brick-type construction modules that are improved in terms of their connecting versatility. In U.S. Pat. No. 6,648,715 (Nov. 18, 2003), Wiens, et al. describe bricks with two single-sex faces that can be mated to one another and four hermaphroditic faces that can be mated to one another. These bricks can be manufactured with relative ease, and they allow any face of a block to mate with at least one other face of an identical block, but they do not allow any face of a block to mate with any other face of an identical block. Tops can be mated to bottoms, and sides can be mated to sides; but tops cannot be mated to tops, sides cannot be mated to tops, sides cannot be mated to bottoms, and bottoms cannot be mated to bottoms.

In addition to the problems already mentioned, all cube and brick modules have at least two more detractions. First, none of these modules are particularly attractive. These known cube and brick modules, which incorporate at least three distinct types of faces, lack the aesthetic appeal of symmetry.

They achieve limited functionality, but they are not beautiful structures in and of themselves. The second detraction of cube and brick blocks is that their space-filling orientations are rather mundane and uninteresting. Their possible building directions are up, down, left, and right. These blocks cannot connect at more novel angles, such as 45 degrees upward and to the right.

"Facially-Symmetric" Construction Modules

Construction modules with symmetric faces are also known in the prior art. Several U.S. Patents (U.S. Pat. Nos. 5,098,328, by Bierens—Mar. 24, 1992; 6,439,571, by Wilson—Aug. 27, 2002; and D359,315, by Tacey—Jun. 13, 1995) describe cube blocks with "six face symmetry." All of these blocks' faces are identical, which allows any face on one of these blocks to connect with any face on another identical block.

These blocks represent improvements over the aforementioned cubes and bricks, in that their connectability is more versatile. Their symmetry also renders them more aesthetically appealing. However, the overarching problem with these prior art "facially symmetric" building blocks is that none of their designs can be easily manufactured as one piece of plastic, using straight-pull injection molding processes. For example, Beerens' patent suggests a method by which his cubes might be manufactured as six separate pieces, which must then be assembled before use.

Hollister describes a somewhat similar plan for a tetrahedron building block with symmetrical faces in his U.S. Pat. No. 6,152,797 (Nov. 28, 2000). Hollister's patent showed how his tetrahedron block might be manufactured as four separate triangular faces and four separate insertable connectors—eight pieces in all. In addition to the cost involved, this required assembly is troubling because it limits the materials that can be used to create these modules; some resins are not easily joined. Furthermore, there is always a danger of these complex modules coming apart, creating safety hazards.

Non-Box Shaped Construction Modules

Most prior art construction modules are box-shaped. Construction modules with other polyhedral geometries have represented a significant challenge to inventors. The advantage of these non-box-shaped building blocks is that they are not limited to vertical and lateral connections. Their faces do not necessarily lie parallel or perpendicular to one another. However, the same interesting geometry that has made them enticing candidates for building blocks has also rendered them impossible to manufacture economically. They have proven especially difficult to manufacture as one piece of material. Hollister's tetrahedron, mentioned in the previous paragraph, provides one example of this difficulty. In U.S. Pat. No. 7,247,075 (Jul. 24, 2007) Von Oech describes a golden right rhombic pyramidal polyhedron that can be manufactured as two pieces of material, plus multiple magnets. In U.S. Pat. No. 5,501,626 (Mar. 26, 1996), Harvey describes polygonal pieces that may be snapped together at their edges to create polyhedra.

Lalvani (U.S. Pat. No. 4,723,382) discloses an icosahedral system of ten polygonal members that may be assembled to create polyhedra as well as planar shapes. Lalvani's basic polygon members may be solid or "open lattice[s]." While Lalvani does disclose a means of connecting multiple panels or lattices to create polyhedra, he does not offer an easily manufactured integral polyhedron. In addition to the art of Lalvani and the others mentioned above, many other such polyhedra, which are constructed from individual, snap-together faces, are known.

Many other polyhedron inventors do not even address the issue of manufacturing. Evans (U.S. Pat. No. 6,257,574) discloses a variety of multi-polyhedral puzzles, where polyhedral blocks abut to form larger structures. Evans shows many configurations and enumerates many geometric specificities of polyhedral blocks, but he does not focus on how those blocks are made.

Viewed collectively, the prior art in construction modules suggests a clear failure to create construction modules with all of the following properties: one-piece, straight-pull, injection moldability; overall aesthetic appeal; compatible connectivity in a variety of directions; and a wide variety of possible polyhedral embodiments.

3. Objects and Advantages

Accordingly, it is the object of my invention to provide a variety of novel construction modules, each with a broad combination of advantages unknown in the prior art.

A first object of my invention is to provide some identical construction modules that can form aligned, face-to-face connections where one planar surface "matches up" and abuts with a compatible surface.

A second object of my invention is to provide some sets of construction modules that are space-filling. In other words, these sets of construction modules can tessellate, fully occupying the cells of a geometric honeycomb.

A third object of my invention is to provide construction modules that can be manufactured as a single piece of material, by a straight-pull injection mold. Such modules have reduced tooling costs, require no assembly, and cannot come unassembled. One-piece modules may also be manufactured in a variety of materials, some of which may pose and assembly problems to a multiple part module.

A fourth object of my invention is to provide some construction modules with unique geometries that transcend the common box shape.

A fifth object of my invention is to provide construction modules that are easily scalable, so that they may satisfy a variety of uses and age groups. A change of scale can also address a number of other manufacturing concerns, such as loose machining tolerances.

A sixth object of my invention is to provide individual modules with interesting symmetries. In a set of my modules, each individual module in a set has interesting symmetry, all by itself. Each can stand alone as a geometric work of art. Furthermore, when my individual modules are mated together, fascinating and continuous symmetry patterns emerge across multiple modules.

A seventh object of my invention is to provide connectively compatible construction modules of differing geometries. For example, some of my embodiments having surfaces coplanar with cubooctahedral, truncated octahedral, and truncated tetrahedral template can be made to fit together in a 3-D tessellation. Connective compatibility also allows variety of modules to be used together as a construction system. In this way, an animal sculpture could have a body made from isosceles tetrahedra and four legs constructed from sets of cubes.

A final object of my invention is to provide construction modules that can be made releasably connectable. All of my embodiments are designed in such a way that snap-fit connectors may be incorporated into their surfaces. The obvious advantage conferred by such connectability is that complex and semi-permanent structures can be built.

Further objects and advantages of my invention will become apparent from a consideration of the drawings and ensuing descriptions.

SUMMARY

My invention is a family of construction modules having two symmetric sets of surfaces. A construction module comprises a first and a second set of mating walls, each set having n-order rotational symmetry about a vertical linear axis. Each set consists of n subsets of mating walls, and each subset occupies a circular sector around the vertical linear axis. The cylindrical sector occupied by each subset is no greater than 180°/n. The first set of surfaces is mappable onto the second set of surfaces by a reflection across a horizontal plane followed by a 180°/n rotation about the vertical linear axis. In the preferred embodiments, at least one set of surfaces lies coplanar with a set of surfaces of a space-filling polyhedron template. Accordingly, a plurality of my modules may be abutted, face to face, to fill space. Furthermore, when viewed along the vertical linear axis, all mating walls are wholly visible. Thus, these modules may be molded as a single piece of plastic with a straight-pull injection mold whose axis of pull parallels the vertical linear axis.

DRAWINGS—FIGURES

FIGS. 8B-8D show how my fourth, fifth, and sixth alternative embodiments mate together and fill space.

DETAILED DESCRIPTION

Preferred Embodiment—FIGS. 1A-1K

Figure 1A:
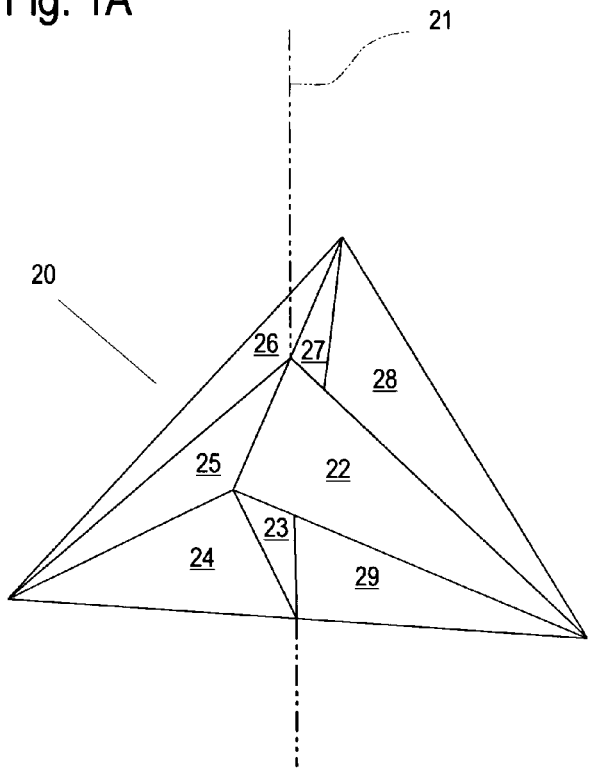
FIG. 1A is a perspective view of my preferred embodiment.

FIG. 1A is a perspective view of the preferred embodiment, module 20, and its vertical linear axis 21. Module 20 has $2^{nd}$ order rotational symmetry about the vertical linear axis. For module 21, n=order of rotational symmetry=2. FIG. 1A shows four mating surfaces or mating walls 22, 24, 26, and 28. The mating walls are so named because they are the portions of module 20 that mate, face to face, with other construction modules. Also shown in FIG. 1A are ancillary walls 23, 25, 27, and 29. The ancillary walls connect the mating walls and facilitate injection molding of the module.

Figure 1B:
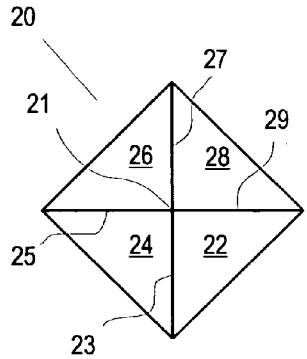
FIG. 1B is a top view of my preferred embodiment.

FIGS. 1B (top view), 1C (side view), and 1D (side view) teach the geometry of module 20. FIG. 1B (vertical linear axis 21 coming out of the page) shows the n-order ($2^{nd}$ order) rotational symmetry of module 20. It can be seen in these diagrams that mating walls 22 and 26 are 360°/n rotations of one another around the vertical linear axis 21. Thus, mating walls 22 and 26 form a first set having n-order rotational symmetry about the vertical linear axis 21. Mating walls 24 and 28 form a second set of mating walls.

Figure 1C:
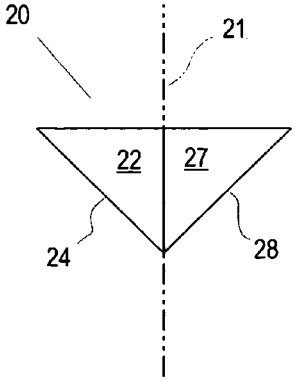
FIG. 1C is a side view of my preferred embodiment.
Figure 1D:
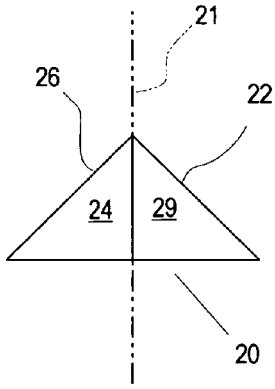
FIG. 1D is a front view of my preferred embodiment.

FIGS. 1C and 1D show that mating walls 22 and 26, and mating walls 24 and 28, are inclined obliquely to the vertical linear axis 21.

Figure 1E:
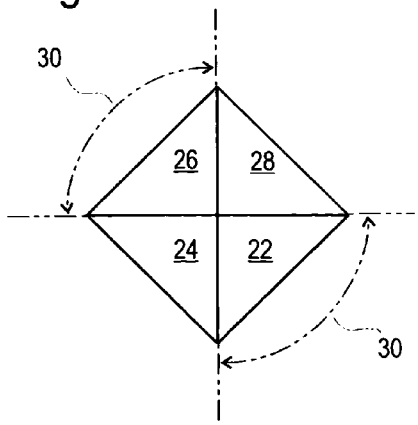
FIG. 1E is a top view of my preferred embodiment.

FIG. 1E (another top view) shows two circular sectors 30. Each circular sector 30 encloses 90°. Circular sectors 30 illustrate an important characteristic of mating walls 22 and 26. When viewed along the vertical linear axis 21 (as in FIG. 1E), mating wall 22 and mating wall 26 both lie completely inside their corresponding circular sector 30. In general terms, mating wall 22 and mating wall 26 each lie completely inside a circular sector enclosing an arc of 180°/n)(90°.

Finally, it can be understood from FIGS. 1A-1E that the first set of mating walls 22 and 26 may be mapped onto the second set of mating walls 24 and 28 via two geometric transformations. This may be accomplished by first reflecting mating walls 22 and 26 across a horizontal mirror plane and by next rotating their images 180°/n(90°) about the vertical linear axis 21.

Figure 1F:
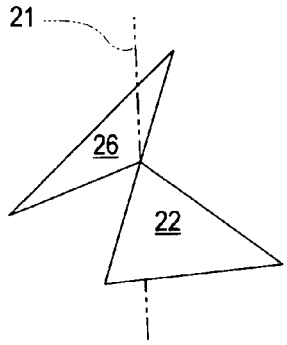
FIG. 1F is a perspective view of a first set of mating walls of my preferred embodiment.
Figure 1G:
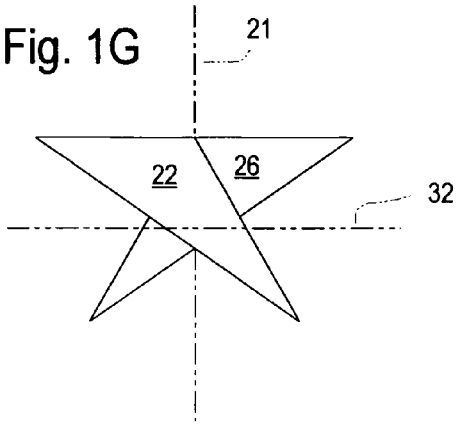
FIG. 1G is a front view of a first set of mating walls of my preferred embodiment.
Figure 1H:
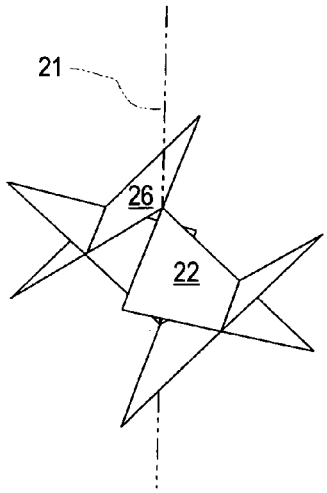
FIGS. 1H-1K are perspective views illustrating the geometry of the mating walls of my preferred embodiment
Figure 1I:
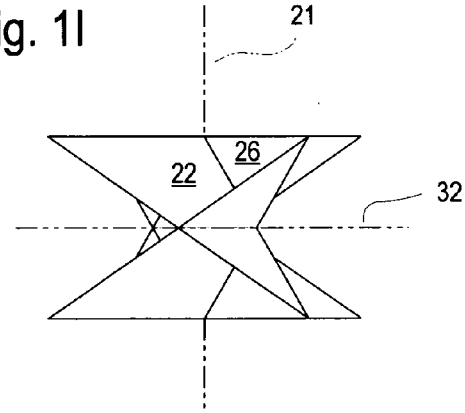
Figure 1J:
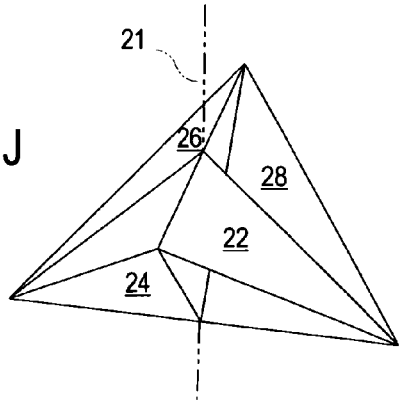
Figure 1K:
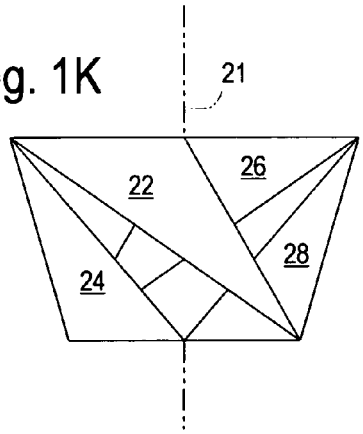

The geometric relationship between the first set of mating walls 22 and 26 and the second set of mating walls 24 and 28 is made clearer in FIGS. 1F-1I. FIG. 1F is a perspective view of mating walls 22 and 26 as they would appear if they were extracted from module 20. In other words, they appear as they do in the module, but the rest of the module is invisible. The vertical linear axis 21 can still be seen. FIG. 1G (side view) shows the same material as what is shown in FIG. 1F, plus the addition of a horizontal mirror plane 32. FIGS. 1H (perspective view) and 1I (side view) show what happens when mating walls 22 and 26 are reflected across horizontal mirror plane 32 (mirror plane 32 depicted only in FIG. 1I). Finally, FIGS. 1J (perspective view) and 1K (side view) show what happens when the reflected "images" are rotated 90° about vertical axis 21. It can be seen that the mating walls 22, 24, 26, and 28 of FIG. 1J are the same as those of module 20 in FIG. 1A.

In summary, FIGS. 1F-1K illustrate that the first set of walls 24 and 28 represent a reflection and a rotation of the second set of mating walls 22 and 26. This reflection is across a horizontal mirror plane, and this rotation is a 180°/n rotation about the vertical linear axis (where n=2 for the preferred embodiment module 20).

FIGS. 1A (perspective) and 1B (top view—along vertical linear axis 21) can be used to understand the ancillary walls 23, 25, 27, and 29. The ancillary walls bridge the gaps between mating walls that appear adjacent when module 20 is viewed along the vertical linear axis 21. In FIG. 1B, mating wall 22 appears adjacent to mating wall 24. Ancillary wall 23 connects the most clockwise edge of mating wall 22 with the most counter-clockwise edge of mating wall 24. Likewise, ancillary wall 25 bridges the gap between adjacent mating walls 24 and 26. Ancillary wall 27 bridges the gap between adjacent mating walls 26 and 28. And, finally, ancillary wall 29 spans the gap between adjacent mating walls 28 and 22.

In FIG. 1B (top view), the ancillary walls are shown on edge. This perspective shows that all of the ancillary walls are substantially vertical in the embodiment of module 20.

Figure 1L:
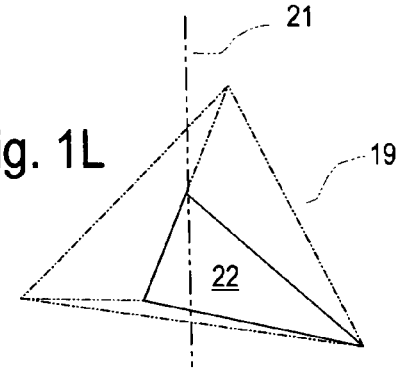
FIG. 1L is a perspective view showing the polyhedral template for my preferred embodiment

It can be understood from the figures that this module 20 was designed to have characteristics of an isosceles tetrahedron. FIG. 1L shows a single mating wall 22 with a superimposed isosceles tetrahedral template 19. An isosceles tetrahedron is a desirable template for a construction module, because it can tessellate and fill space. The inclinations of mating walls 22, 24, 26, and 28, relative to the vertical linear axis, were chosen so that those mating walls would be coplanar with the surfaces of a superimposed isosceles tetrahedral template.

It is important to not that the mating walls could have been inclined to the vertical linear axis 21 at any oblique angle. The module could still have been created, and it would still have "worked." Furthermore, any mirror plane would have "worked," but the particular mirror plane that was chosen was selected so that every mating wall would be coplanar with a hypothetical superimposed isosceles tetrahedral template.

HOW TO MAKE THE PREFERRED EMBODIMENT. The following is an alternative, "how-to," narrative explaining the method of creating the preferred embodiment.

First, define the vertical linear axis 21 and select a polyhedral template 19 (FIG. 1L, perspective view) with rotational symmetry. Orient the template so that it has rotational symmetry about the vertical linear axis 21. Determine the order of the template's rotational symmetry, and set n equal to that order. In the case of module 20 the template 19 has $2^{nd}$ order rotational symmetry about the vertical linear axis 21, so n=2. Create a mating wall 22 that is coplanar with a wall of the template. Adjust mating wall 22 so that, when viewed along vertical linear axis 21, mating wall 22 does not extend beyond a 180°/n circular sector 30 (FIG. 1E, top view). Create another mating wall 26 that is a 360°/n rotation of mating wall 22 about the vertical linear axis 21 (FIGS. 1F, perspective view and 1G, side view). Create a second pair of mating walls 24 and 28 (FIGS. 1H, perspective view; and 1I, side view). Mating walls 24 and 28 must represent a reflection plus a rotation of mating walls 22 and 26. To establish these mating walls, reflect mating walls 22 and 26 across a horizontal mirror plane 32, and then rotate them 180°/n (here n=2) about the vertical linear axis 21. The transition from FIGS. 1H and 1I to FIGS. 1J and 1K illustrates this rotation. This compound geometric transformation will map mating walls 22 and 26 onto the positions of the new mating walls 24 and 28. Please note that, in this case, the horizontal mirror plane 32 passes through the midpoint of the hypotenuse of mating wall 24.

Once these mating walls are established, the essence of this invention is in place. The remainder of the module design requires no special skill. Next, understand that the module 20 will be molded with an axis of mold pull paralleling the vertical linear axis 21. While viewing the mating walls along this axis, determine which mating walls appear adjacent from this viewpoint. Provide an ancillary wall that bridges the gap between the edges of each pair of mating walls that appear adjacent from this viewpoint. The method above ensures that the mating walls will not present undercuts with this axis of mold pull. Care must still be taken to not add ancillary walls that will create undercuts. This is, however, a relatively simple task requiring no special skill.

OPERATION—PREFERRED EMBODIMENT

FIGS. 2A-2G

End-User Operation

The end-user purpose of my invention is to provide a set of construction modules that can be mated together, face-to-face to create interesting patterns.

Figure 2A:
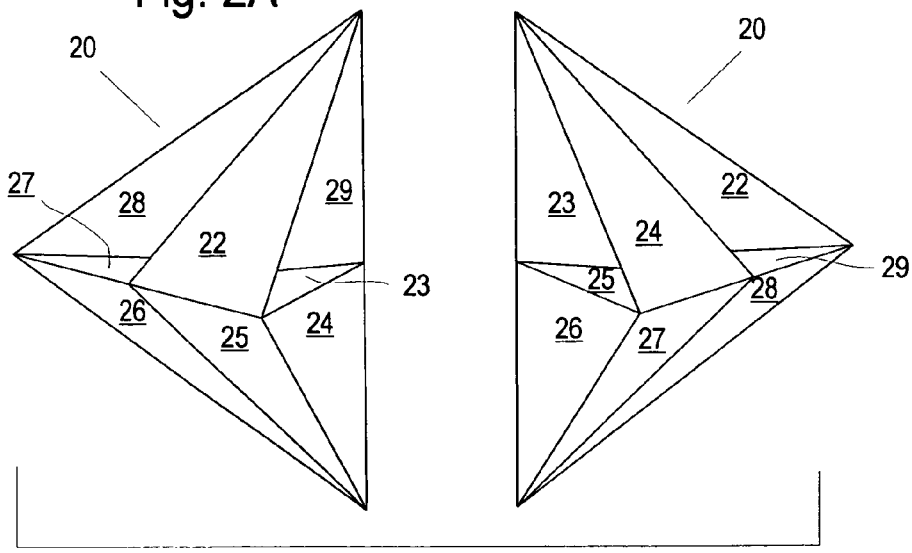
FIGS. 2A-2C are perspective views showing how my preferred embodiment modules mate together.

FIG. 2A (perspective view) shows two identical modules 20 poised for mating. Mating wall 24 on the left hand module is ready to mate with mating wall 26 of the right hand module. It is important to notice that mating surfaces 24 and 26 are mirror images of one another. This is what makes face to face mating possible; mirror images may always be matched up in at least one orientation.

Figure 2B:
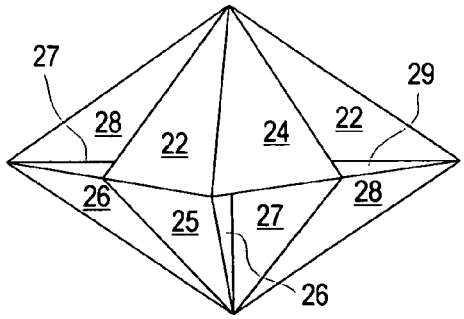

FIG. 2B (perspective view) shows what happens after the two modules 20 of FIG. 2A have mated.

Figure 2C:
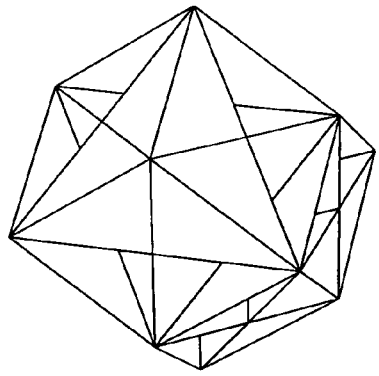

FIG. 2C (perspective view) shows a collection of twenty-four identical modules 20, which have been mated together to fill space. Their overall shape is a rhombic dodecahedron.

Manufacturing Operation

One extremely important operational aspect of my modules 20 pertains to their ability to be molded in one piece with a straight-pull injection mold. It can be understood from FIG. 1A and FIG. 1B (top view) that module 20 may be molded with an axis of mold pull paralleling the vertical linear axis 21. Along this axis, there are no undercuts, so injection molding is possible with a straight-pull mold. This virtue stems from the facts that 1) each mating surface occupies no more than a 180°/n circular sector when viewed along the vertical linear axis 21 and 2) the mating walls 24 and 28 represent 180°/n rotations of mating walls 22 and 26. This arrangement keeps the mating walls from "blocking one another" when viewed along the vertical linear axis 21. FIG. 1B (top view) provides a perspective parallel to the anticipated direction of mold pull (along the vertical linear axis). From this perspective, all of the mating walls are visible. This would also be true of a bottom view. In either direction along the vertical linear axis, all of the mating walls are visible to an observer. This visibility ensures moldability without undercuts. The remainder of the module, the ancillary walls, all lie essentially parallel to the vertical linear axis and therefore do not create molding undercuts.

Moldability as a single piece of material makes these modules economical as well as safe; they have no assemblies that must be put together and that may later come apart. One-piece moldability also allows my modules to be manufactured in a variety of materials, some of which might be very good materials for toys, but which might also be very difficult to bond in a multiple-part toy.

Figure 2D:
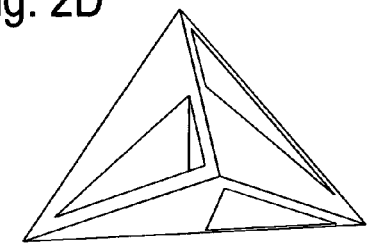
FIGS. 2D and 2E are perspective views of a thicker-walled version of my preferred embodiment.
Figure 2E:
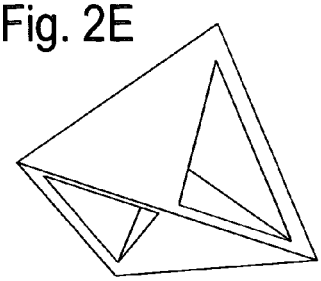
Figure 2F:
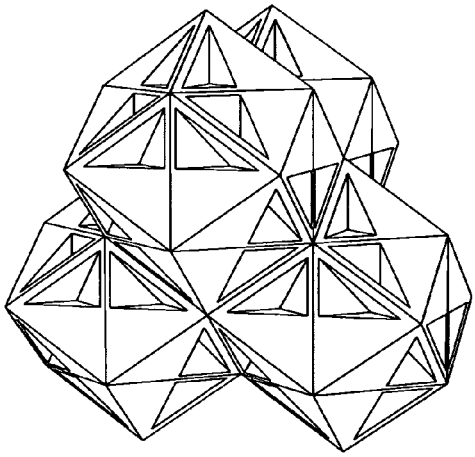
FIG. 2F is a perspective view of a tetrahedral structure comprising 96 aligned iterations of the preferred embodiment's polyhedron template.
Figure 2G:
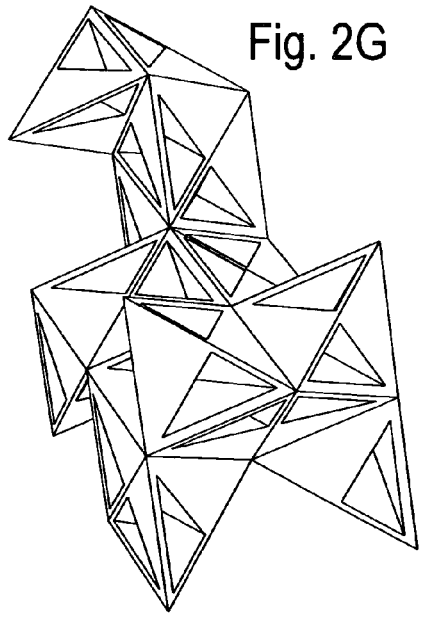
FIG. 2G is a perspective view of a cat sculpture comprising iterations of the preferred embodiment.

For simplicity, the preferred embodiment module 20 has been depicted with very thin walls. In actual manufacture, however, the walls would have substantial thickness. It is very easy to modify the design shown here to achieve the thin and even wall thicknesses that are most suitable for injection molding. FIGS. 2D and 2E are perspective views of a module 20 with even wall thicknesses suitable for injection molding. FIG. 2F shows a plurality (ninety-six) of these thicker-walled modules 20 forming four rhombic dodecahedra, which are, in-turn forming a tetrahedral structure. FIG. 2G shows a plurality of these modules 20 mated together to form a cat.

First Alternative Embodiment

FIGS. 3A-3D

Figure 3A:
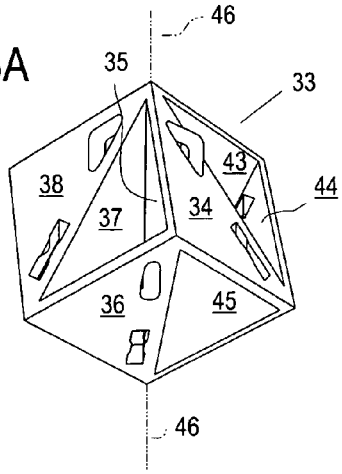
FIGS. 3A and 3B are perspective views of my first alternative embodiment.

FIGS. 3A-3D show a first alternative embodiment, module 33, having $3^{rd}$ order symmetry. For module 33, n=the order of symmetry=3. Module 33 has two sets of mating walls. The first set comprises n mating walls 34, 38, and 42. The second set of mating walls comprises another n mating walls 36, 40, and 44. The second set is a 360°/n rotation of the first set. FIG. 3A (side perspective view) shows a vertical linear axis 46. It can be understood from FIGS. 3A and 3C (top view) that the first set of mating walls 34, 38, and 42 has n-order symmetry about the vertical linear axis 46. In the case of module 30, the first set of mating walls 34, 38, and 42 are inclined obliquely to the vertical linear axis 46. Their angle of inclination is approximately 35.3°.

Figure 3B:
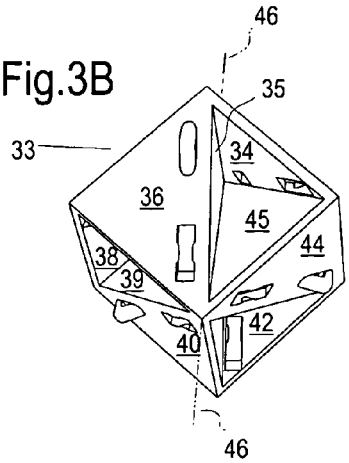
Figure 3C:
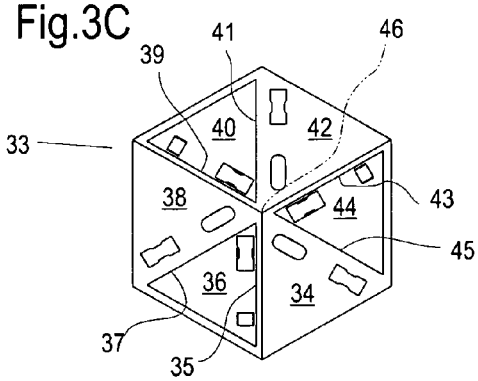
FIGS. 3C and 3D are top and bottom views, respectively, of my first alternative embodiment.
Figure 3D:
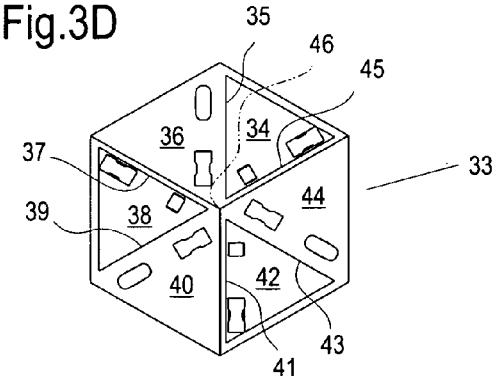

By examining FIGS. 3A and 3C, in addition to FIG. 3B (bottom perspective) and FIG. 3D (bottom view), it can be confirmed that the second set of mating walls 36, 40, and 44 represent a reflection plus a rotation of the first set of mating walls 34, 38, and 42. The first set is mappable onto the second set by reflection across a horizontal mirror plane and then a 180°/n (e.g. 60°) rotation about the vertical linear axis 46. The reflection is indicated by a comparison of the top view of FIG. 3C with the bottom view of FIG. 3D. These two views show that the two sets of mating walls are mirror images of one another. The 60° rotation is observable in these same figures, as the two sets of mating walls appear staggered in top and bottom views. They are offset in these top and bottom views by 60°.

FIG. 3C (top view) shows on-edge views of ancillary walls 35, 37, 39, 41, 43, and 45. These ancillary walls are shown on edge. From this perspective, those ancillary walls can be understood to join adjacent mating walls. Please note that this adjacency is determined from a perspective along the vertical linear axis 46. Thus both the top and bottom views of FIGS. 3C and 3D show the ancillary walls to be bridging the gaps between adjacent mating walls.

It is readily apparent from FIGS. 3A-3D that the inclinations of the mating walls in this embodiment were chosen to give the module 33 a cubical structure. Accordingly, the module 33 can mate with other such modules to form structures that can be built with cubes.

Furthermore, this embodiment has been depicted in FIGS. 3A-3D as having snap connectors. While snap connectors are not part of the present invention, these drawings show that they may readily be incorporated into these modules.

FIGS. 3I-3M

The essence of this invention may also be understood from FIGS. 3I-3M. These figs may serve as a "how-to" manual explaining the method behind the placements of mating walls 34, 36, 38, 40, 42, and 44.

Figure 3E:
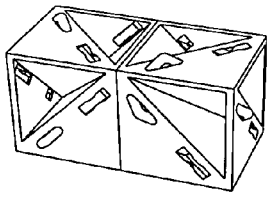
FIGS. 3E-3H are perspective views of multiple versions of my first alternative embodiment, mated together.
Figure 3F:
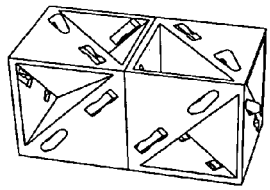
Figure 3G:
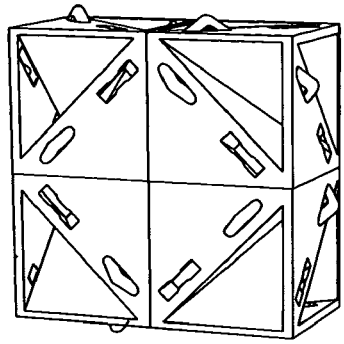
Figure 3H:
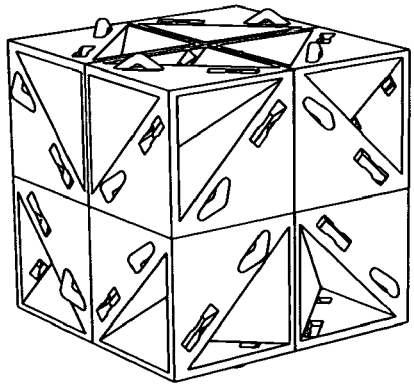
Figure 3I:
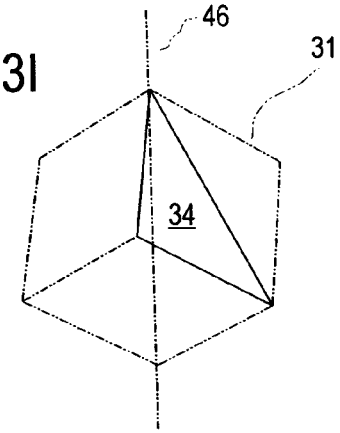
FIGS. 3I-3M are illustrations explaining the geometry of my first alternative embodiment.

First, a polyhedron template 31 was chosen because it has that has rotational symmetry (FIG. 3I, perspective view). The template 32 was oriented so that it has rotational symmetry about the vertical linear axis 46. The order of rotational symmetry of the template 31 was determined to be $3^{rd}$ order. The value of "n" was established to be 3 (the order of rotational symmetry).

Figure 3J:
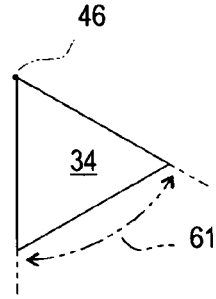

Second, a mating wall 34 was created such that it is coplanar with one of the surfaces of the template 31. The size of the mating wall 34 was restricted so that it occupies a circular sector no greater than 180°/n(60°) when viewed along the vertical linear axis. FIG. 3J (top view) shows a view along the vertical linear axis 46. A circular sector 61 enclosing 180°/n=60° is shown. FIG. 4I shows that mating wall 34 fits within circular segment 71.

Figure 3K:
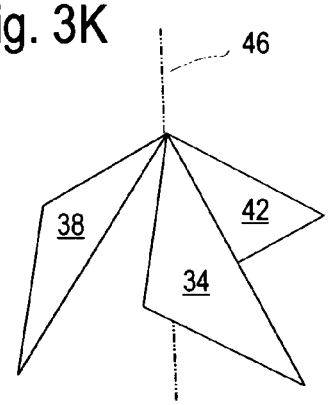

Third, two more mating walls 38 and 42 were established by rotating mating wall 34 multiples of 360°/n about the vertical linear axis 46 (FIG. 3K, perspective view). This was repeated until a first set of mating walls had n order rotational symmetry about the vertical linear axis 46.

Figure 3L:
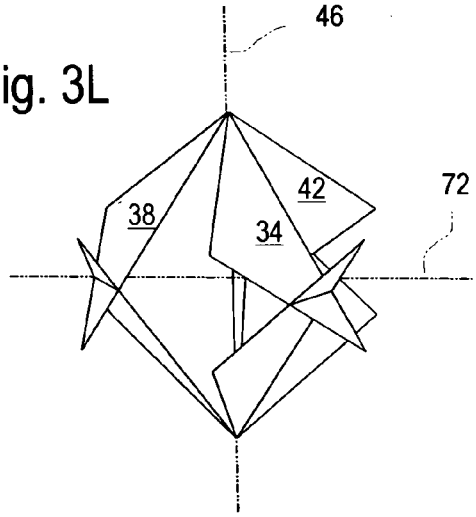
Figure 3M:
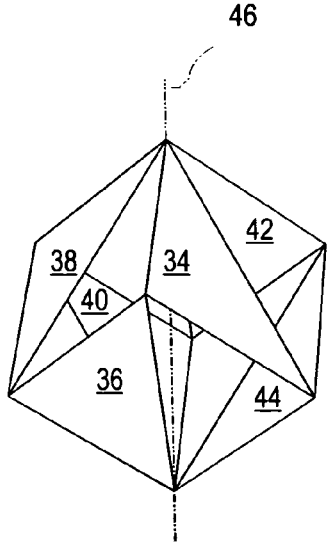
Figure 3N:
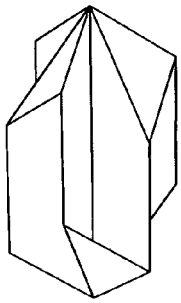
FIGS. 3N-3S are perspective views of modules created by moving the mirror plane of my first alternative embodiment.

Fourth, a second set of mating walls was created such that the second set was mappable onto the first set. This was done by first reflecting the first set of mating walls 34, 38, and 42 across a horizontal mirror plane (FIG. 3L, perspective view). In FIG. 3L, the approximate position of the mirror plane is indicated by a broken line 72. Please note that, in this case, the mirror plane passes through the midpoint of the leg of mating wall 34 that is most distant from the vertical linear axis 46. In addition to this reflection, the first set of mating walls was also rotated 180°/n about the vertical linear axis 46. FIG. 3M (perspective view) shows the effect of rotating the first set of mating walls from their reflected positions in FIG. 3L to the actual positions of mating walls 36, 40, and 44.

The final step in transforming the parts of FIG. 3M into the moldable module of FIGS. 3A-3D requires no special skill. One simply accepts that the direction of mold pull will be parallel to vertical linear axis 46, and then one adds ancillary walls or "filler" to connect the mating walls. This must be done in a way that prevents undercuts from appearing, but it is not a difficult task.

Variations on this Embodiment

FIGS. 3N-3S

Figure 3O:
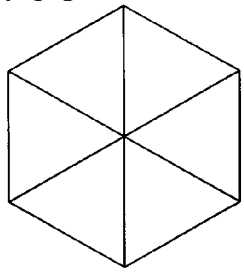
Figure 3P:
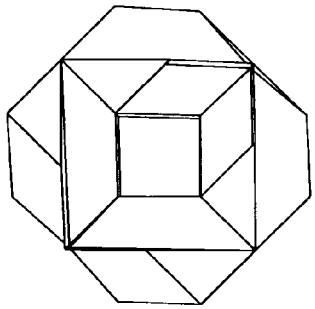

Module 33 of FIGS. 3A-3F are essentially cubical. This is the case because the proper horizontal mirror plane 72 was chosen (FIG. 3L). The modules of FIGS. 3N-3S show how new modules may be created simply by altering this horizontal mirror plane. The module of FIG. 3N was produced by moving the horizontal mirror plane downward from its position in FIG. 3L. FIG. 3O is a top view of the module of FIG. 3N. FIG. 3P shows four of these modules mated together. Interestingly, these modules still exhibit cubic space-filling properties.

Figure 3Q:
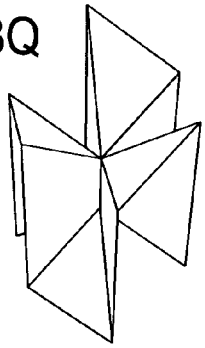
Figure 3R:
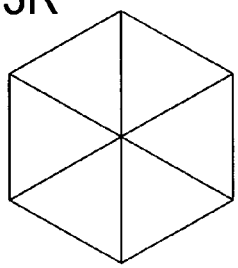
Figure 3S:
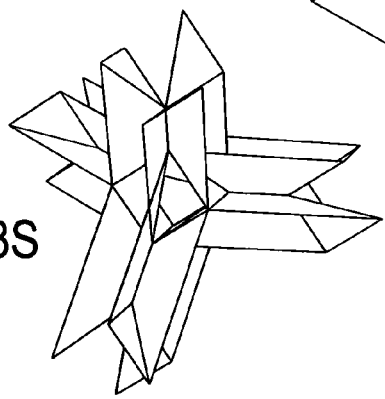

The module of FIG. 3Q was produced by moving the horizontal mirror plane upward from its position in FIG. 3L. FIG. 3R is a top view of the module of FIG. 3Q. FIG. 3P shows four of these modules mated together to form a tetrahedral structure.

First Alternative Embodiment

FIGS. 3E-3H

FIGS. 3E and 3F (both perspective views) show that individual modules 30 of this embodiment can mate in two different ways. As is true will all of the embodiments of this invention, the minor-image mating walls of the first and second mating wall sets can mate face-to-face. In addition, since the mating walls of these cuboidal modules have minor symmetry, any mating wall may be mated with any other mating wall. FIG. 3E shows the pattern that results when a mating wall of the first set (36, 40, or 44) mates face to face with a mating wall of the second set (34, 38, or 42). FIG. 3F shows the pattern that results when a mating wall mates face to face with a mating wall of its own set (albeit, on a different module). FIGS. 3G and 3H are perspective views showing multiple versions of module 46, mated together to fill space.

FIGS. 3A-3D also show that module 33 may be molded with a straight pull mold whose axis of mold pull parallels the vertical linear axis 46. FIG. 3C (top view) provides a perspective parallel to the anticipated direction of mold pull (along the vertical linear axis). From this perspective, all of the mating walls are visible. This would also be true of a bottom view. In either direction along the vertical linear axis, all of the mating walls are visible to an observer. This visibility ensures moldability without undercuts.

Second Alternative Embodiment

FIGS. 3A-3C

Figure 4A:
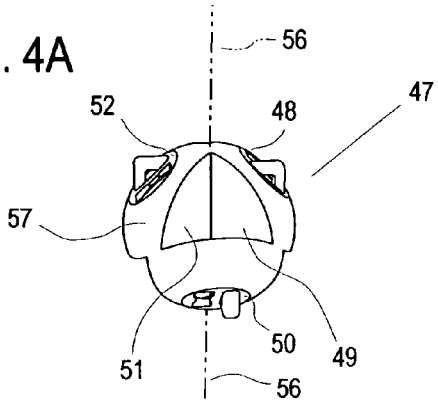
FIGS. 4A-4C show my second alternative embodiment.
Figure 4B:
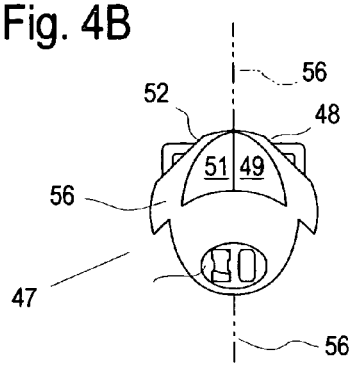
Figure 4C:
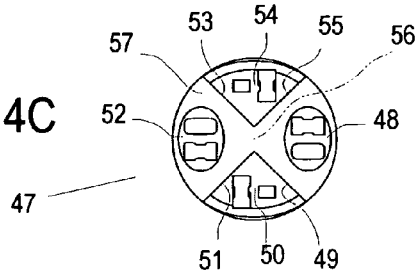

FIG. 4A (perspective view) and FIG. 4C (top view) show a module 47 with n-order (n=2) rotational symmetry about a vertical linear axis 56. Module 47 has a first set of mating walls, 48 and 52 which are inclined to the vertical linear axis 56 at an angle of approximately 45°. These mating walls are circular in shape. This first set of mating walls has n-order rotational symmetry about the vertical linear axis 56. Furthermore each mating wall 48 and 52 occupies a circular sector, when viewed along the vertical linear axis 56, no greater than 180°/n.

Module 47 has a second set of mating walls 50 and 54, which are mappable onto the first set of mating walls by a reflection across a horizontal mirror plane plus a 180°/n rotation about the vertical linear axis 56.

Figure 4D:
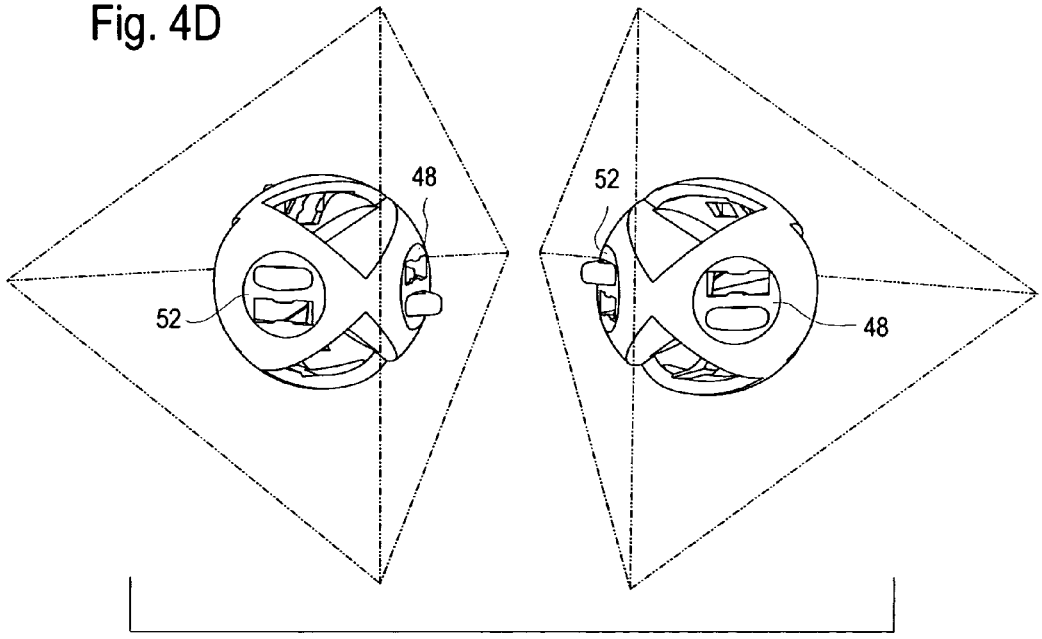
FIGS. 4D-4G show how my second alternative embodiments mate together.
Figure 4E:
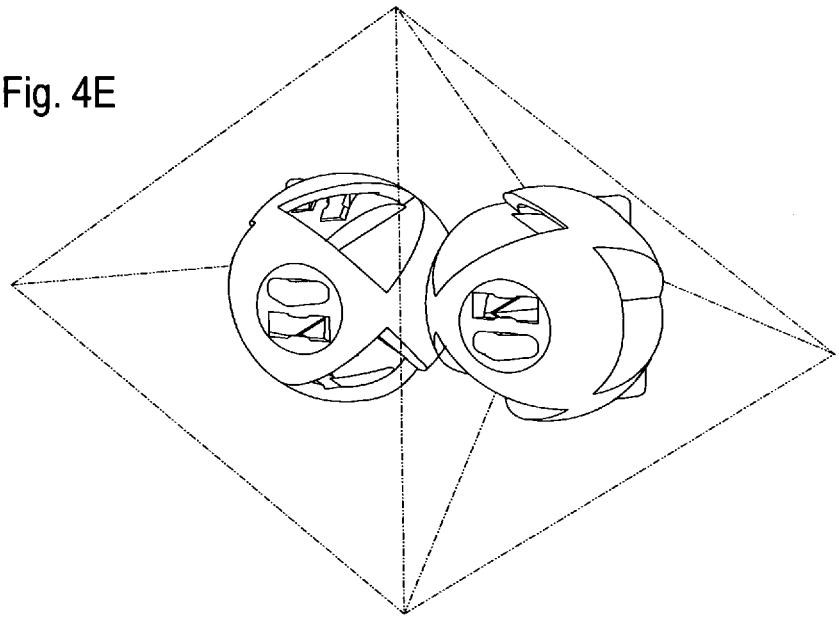
Figure 4F:
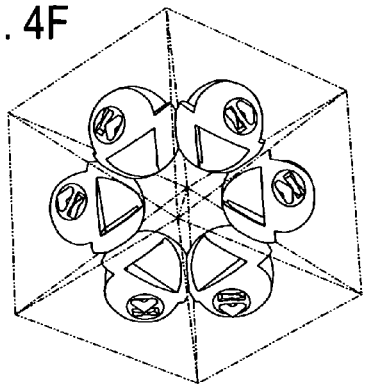
Figure 4G:
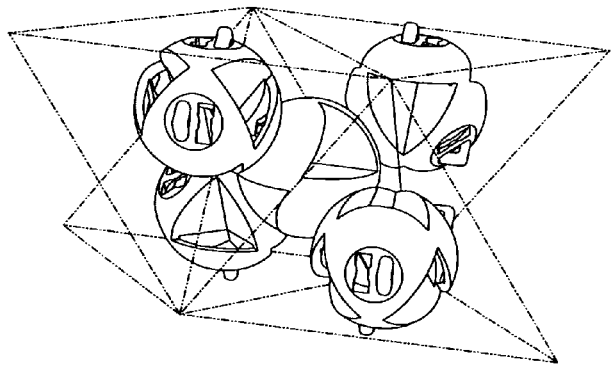

FIG. 4D (perspective view) shows two modules 47 with superimposed isosceles tetrahedra. This figure shows that every mating wall of this module is coplanar with a surface of a hypothetical superimposed isosceles polyhedron.

Method Description

FIGS. 4H-4K, 4A, 4C

The true nature of this invention may also be understood from FIGS. 4H-4K, which serve as a "how-to" manual explaining the method behind the placements of mating walls 48, 50, 52, and 54.

Figure 4H:
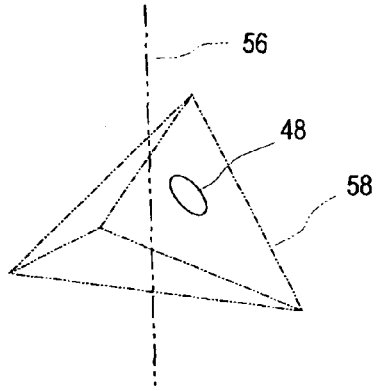
FIGS. 4H-4L are illustrations explaining the geometry of my second alternative embodiment.
Figure 4I:
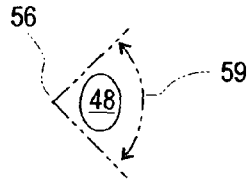

First, select a polyhedron template 58 (FIG. 4H, perspective view) that has rotational symmetry. Then orient the template 58 so that it has rotational symmetry about the vertical linear axis 56. Determine the order of rotational symmetry of the template 58. In FIG. 4H, the template 58 has $2^{nd}$ order rotational symmetry about the vertical linear axis 56, so record order of rotational symmetry as n=2.

Second, create a mating wall 48 that is coplanar with one of the surfaces of the template 58. Restrict the size of the mating wall 48 so that it occupies a circular segment no greater than 180°/n when viewed along the vertical linear axis. FIG. 4I (top view) shows a circular sector 59 enclosing 180°/n(90°). FIG. 4I shows that mating wall 48 fits within circular segment 59. The mating wall 48 is circular, though it appears ovoid due to the perspective of this figure.

Figure 4J:
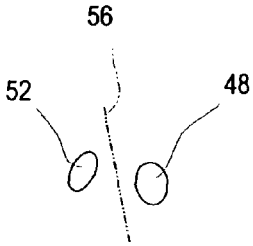

Third, create a second mating wall 52, such that it is a 360°/n rotation of mating wall 48 about the vertical linear axis 56. FIG. 4J (perspective view) shows this relationship. This ensures that mating walls 48 and 52 are a "first set" with n-order rotational symmetry about the vertical linear axis 56.

Figure 4K:
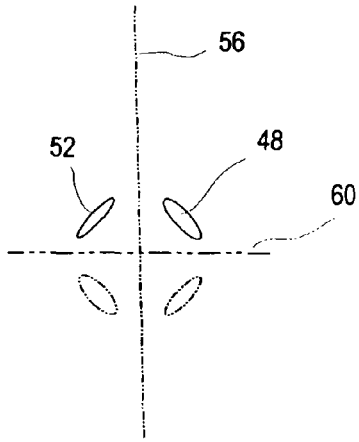
Figure 4L:
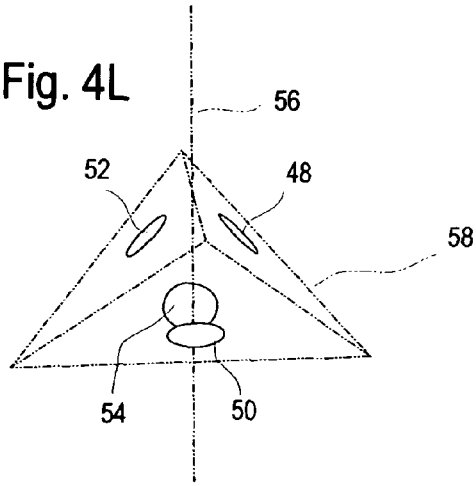

Fourth, create another set of mating walls 54 and 50 that is mappable onto mating walls 48 and 52. Do this by first reflecting mating walls 52 and 48 across a horizontal mirror plane. This reflection is shown in FIG. 4K (perspective view). The horizontal mirror plane is represented in this diagram as broken line 60. In addition to reflecting the mating walls, rotate them 180°/n about the vertical linear axis 56. FIG. 4L (perspective view) shows the effect of rotating the mating walls from their reflected positions in FIG. 4K to the actual positions of mating walls 54 and 50.

FIG. 4L also shows the superimposed template 58. Notice that all of the mating walls are coplanar with surfaces of the template. By comparing this figure with FIGS. 4A-4C, one can see that FIG. 4L does show the same relative positions of the mating walls of module 47.

The final step in transforming the mating walls of FIG. 4L into the moldable module of FIG. 4A requires no special skill. A designer must simply acknowledge that the direction of mold pull will be parallel to vertical linear axis 56. Then one must add ancillary walls or "filler" to connect the mating walls. This must be done in a way that prevents undercuts from appearing, but it is not a difficult task.

Second Alternative Embodiment

FIGS. 4D-4G

FIGS. 4D-4G show that the multiple versions of module 47 can mate face to face and fill space in the manner of isosceles tetrahedra. Isosceles tetrahedra are shown superimposed over the modules in these figures.

FIGS. 4A-4C make it apparent that module 47 may be molded with a straight pull mold whose axis of mold pull parallels the vertical linear axis 56. FIG. 4C (top view) provides a perspective parallel to the anticipated direction of mold pull (along the vertical linear axis). From this perspective, all of the mating walls are visible. This would also be true of a bottom view. In either direction along the vertical linear axis, all of the mating walls are visible to an observer. This visibility ensures moldability without undercuts.

Third Alternative Embodiment

FIGS. 5A-5H

Figure 5A:
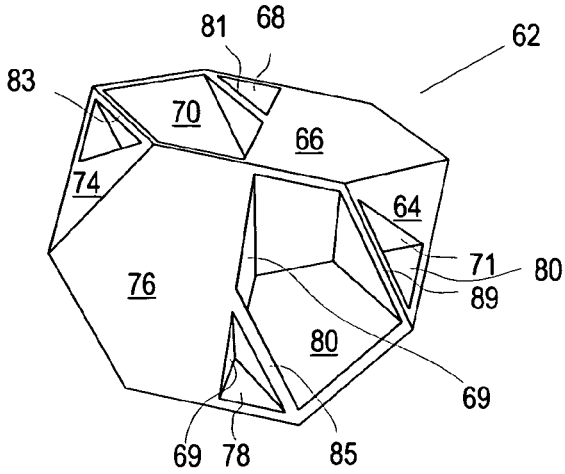
FIGS. 5A-5C show my third alternative embodiment.

FIGS. 5A (Perspective View), 5B (top view), and 5C (bottom view): A construction module 62 has a first set of mating walls 64, 66, 74, and 76 and a second set of mating walls 68, 70, 78, 80. The purpose of these mating walls is to "match up," face to face, with other modules, during construction. Module 62 also has ancillary walls 63, 67, 69, 71, 73, 75, 77, and 79. The ancillary walls serve to connect the mating walls and to facilitate injection molding. Additionally, module 62 has cosmetic walls 81, 83, 85, 89, 91, 93, 95, and 97. These cosmetic walls are not absolutely necessary, but they give the module 62 the look of a polyhedron. They also increase the surface area that abuts when two modules are mated together, face to face.

Third Alternative Embodiment

FIGS. 5D-5H

The essence of this invention may also be understood from FIGS. 5D-5H. These figs may serve as a "how-to" manual explaining the design method behind the placements of the mating walls of module 62.

Figure 5B:
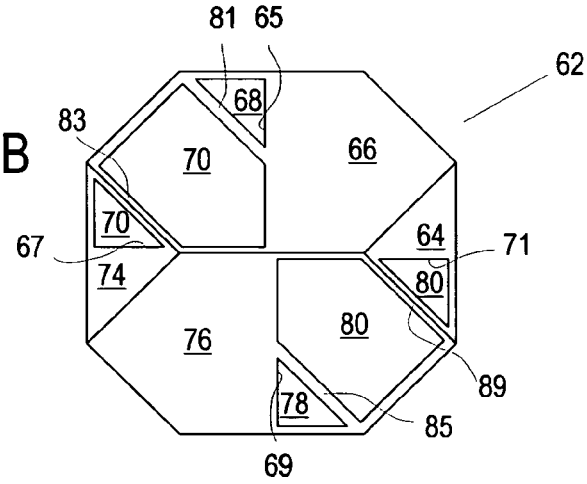
Figure 5C:
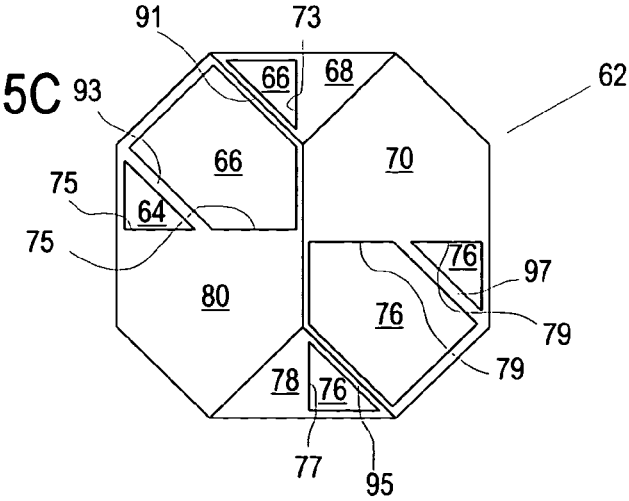
Figure 5D:
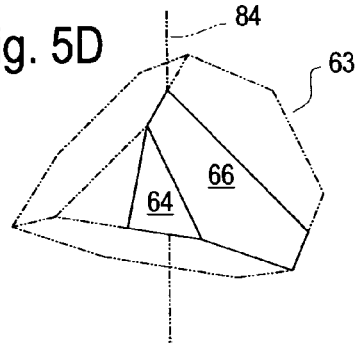
FIGS. 5D-5H are illustrations explaining the geometry of my third alternative embodiment.

First, a polyhedron template 63 was chosen because it has that has rotational symmetry (FIG. 5D, perspective view). The template 63 was oriented so that it has rotational symmetry about the vertical linear axis 84. Template 63 is a truncated isosceles tetrahedron. The order of rotational symmetry of the template 63 was determined to be $2^{nd}$ order. The value of "n" was established to be 2 (the order of rotational symmetry).

Figure 5E:
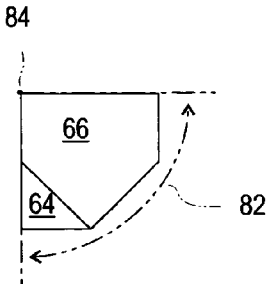

Second, a first subset of mating walls was created such that those mating walls were coplanar with surfaces of the template 63. This first subset consists of mating walls 64 and 66. Mating wall 64 is a half of a hexagonal face of a truncated isosceles tetrahedron. Mating wall 66 is a half of a triangular face of a truncated isosceles tetrahedron. The overall size of this first subset was restricted so that it occupies a circular sector no greater than 180°/n(90°) when viewed along the vertical linear axis 84. FIG. 5E (top view) shows the first subset (mating walls 64 and 66) from a view along the vertical linear axis 84. A circular sector 82 enclosing 180°/n=90° is shown. FIG. 5E shows that the subset consisting of mating walls 64 and 66 fits within circular segment 82.

Figure 5F:
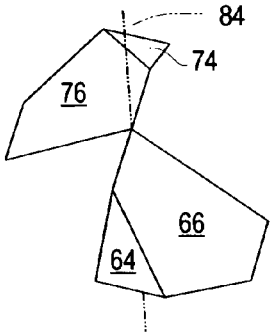

Third, a second subset of mating walls was established by rotating the first subset multiples of 360°/n about the vertical linear axis 84 (FIG. 5F, perspective view). This was repeated until a first set of mating walls had n order rotational symmetry about the vertical linear axis 84. In this case, the $2^{nd}$ order symmetry requires a total of only two subsets. The second subset consists of mating walls 74 and 76. Together, these two subsets comprise a first set of mating walls 64, 66, 74, and 76.

Figure 5G:
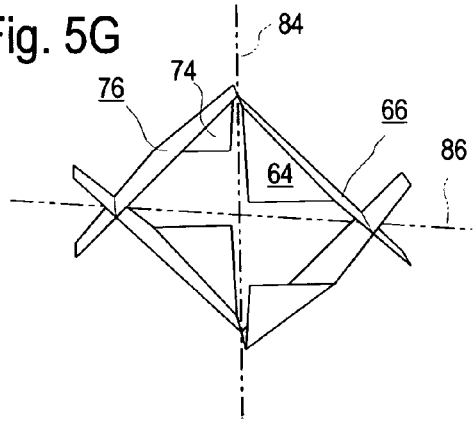
Figure 5H:
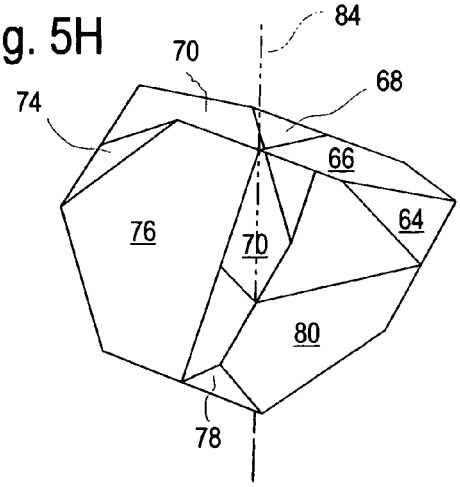

Fourth, a second set of mating walls was created such that the second set was mappable onto the first set. This was done by first reflecting the first set of subsets (mating walls 64, 66, 74, and 76) across a horizontal mirror plane (FIG. 5G, perspective view). In FIG. 5G, the approximate position of the mirror plane is indicated by a broken line 86. If a superimposed truncated isosceles tetrahedral template had been shown in this figure, mirror plane 86 would have passed through its vertical midpoint ["vertical midpoint" means half way between the lowest point and the highest point]. In addition to this reflection, the first set of mating walls was also rotated 180°/n about the vertical linear axis 84. FIG. 5H (perspective view) shows the effect of rotating the first set of mating walls from their reflected positions in FIG. 5G to the actual positions of mating walls 68, 70, 78, and 80.

The final step in transforming the parts of FIG. 5H into the moldable module of FIGS. 5A-5C requires no special skill. One simply accepts that the direction of mold pull will be parallel to vertical linear axis 84, and then one adds ancillary walls or "filler" to connect the mating walls.

FIG. 5A shows that additional cosmetic walls 81, 83, 85, 89, 91, 93, 95, and 97 must also be added. These walls must be added in a way that prevents undercuts from appearing, but it is not a difficult task.

Figure 5I:
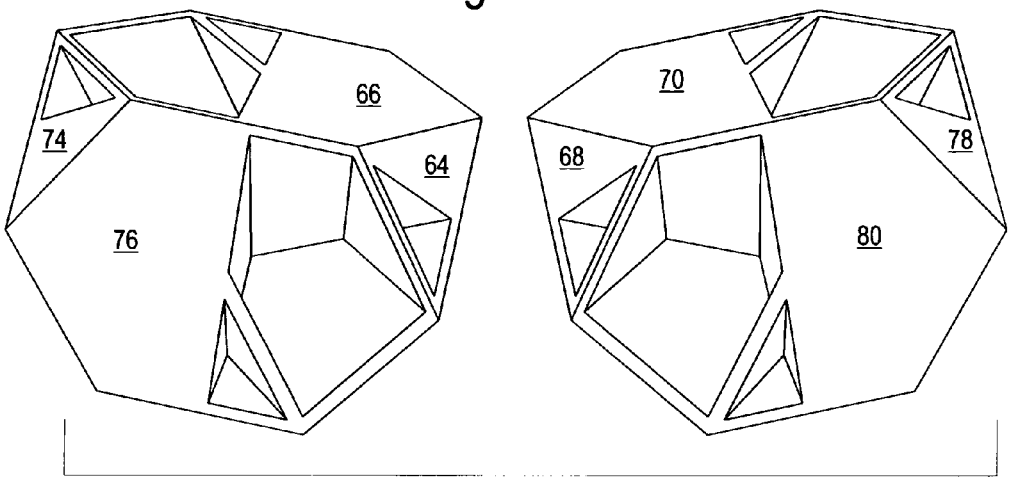
FIGS. 5I-5J show how my third alternative embodiments mate together.
Figure 5J:
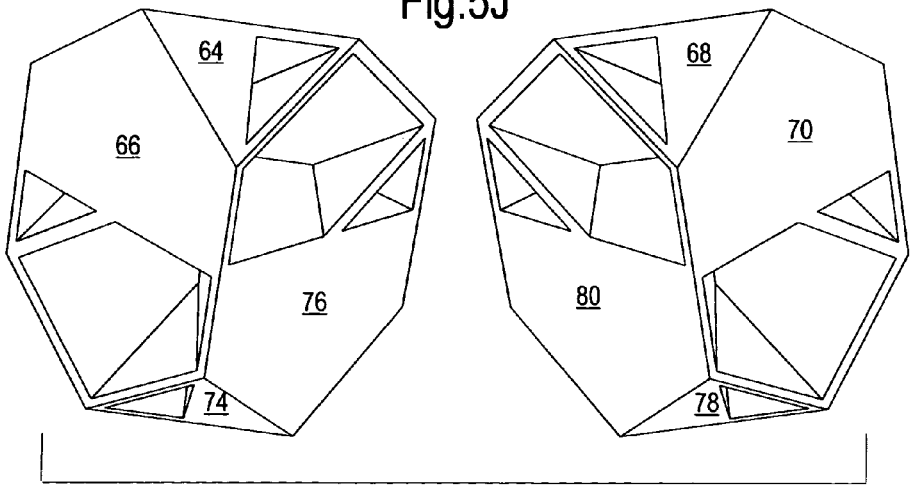
Figure 5K:
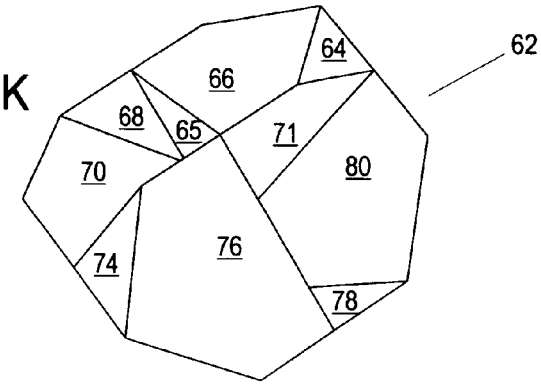
FIGS. 5K-5O show a variant of my third alternative embodiment.

Alternatively, the cosmetic walls may be left out, producing the version of module 62 shown in FIG. 5K.

Third Alternative Embodiment

FIGS. 5I-5O and 5A-5C

FIGS. 5I and 5J (both perspective views) show two ways in which two modules 62 can mate face to face. In both of these views, one set of mating faces is visible on one module, while the other set is visible on the second module. In both figures, it can be seen that the first set of mating walls 64, 66, 74, and 76 represents a mirror image of the second set of mating walls 68, 70, 78, and 80. From these diagrams, it is clear that this characteristic that allows the mating walls to be "matched up" face-to face.

Figure 5L:
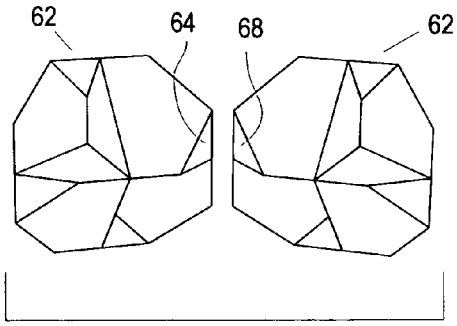
Figure 5M:
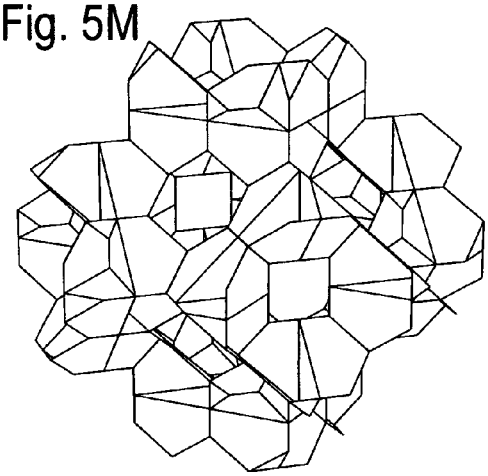
Figure 5N:
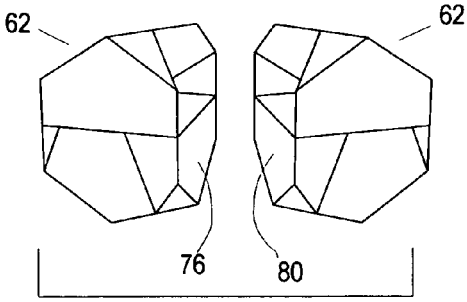
Figure 5O:
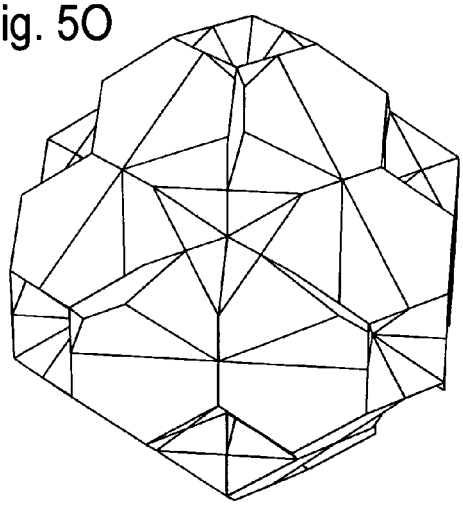

FIGS. 5K-5O show more ways in which modules 62 can mate with one another. FIG. 5L suggests a potential connection between mating walls 64 and 68. FIG. 5M shows twenty-four modules connected together using this connection. FIGS. 5N and 5O show a connection such as that between mating walls 76 and 80.

FIGS. 5A-5C make it apparent that module 62 may be molded with a straight pull mold. The axis of mold pull is along the vertical linear axis 84 shown in FIG. 5H. From either direction along the vertical linear axis, all of the mating walls are visible to an observer.

Fourth Alternative Embodiment

FIGS. 6A-6E

Figure 6A:
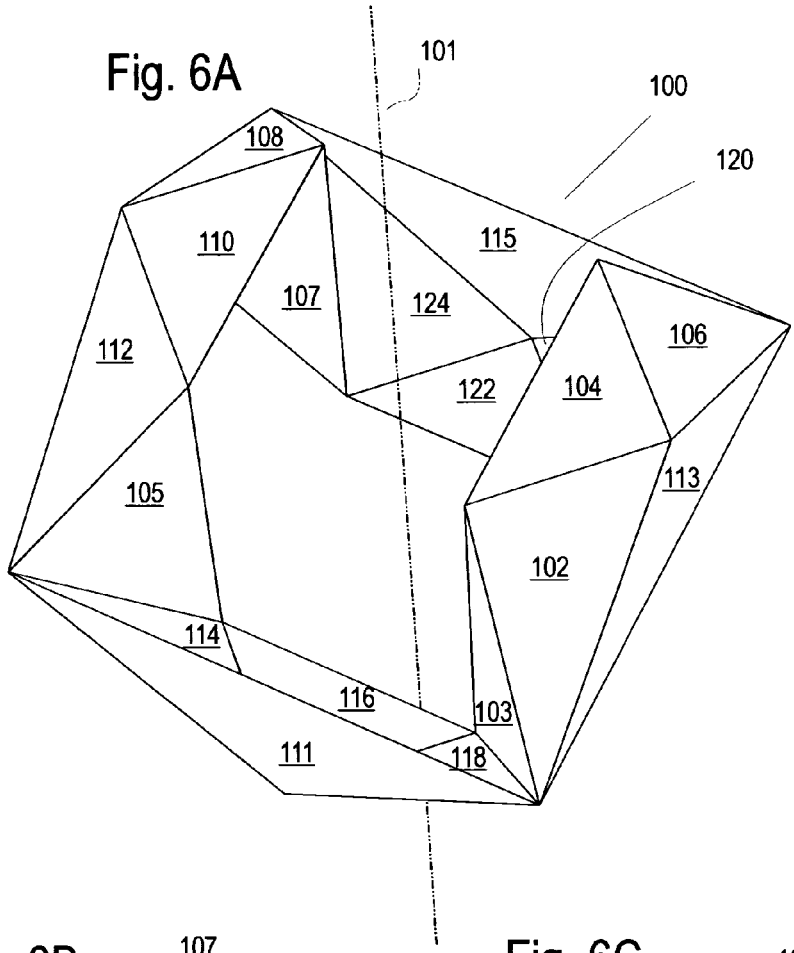
FIGS. 6A-6E show my fourth alternative embodiment

FIGS. 6A (perspective view), 6B (top view), and 6C (bottom view) show a module 100 with n-order (n=2) rotational symmetry about a vertical linear axis 101. The angles of module 101 are based on a cubooctahedral template. FIG. 6A shows a first subset of mating walls 102, 104, and 106. Also shown is a second subset of mating walls (108, 110, and 112) representing a 360°/n rotation of the first subset. Thus the two subsets form a first set with n-order rotational symmetry about the vertical linear axis 101.

A second set of mating walls is also shown. This second set includes a first subset of mating walls 120, 122, and 124; and a second subset of mating walls 114, 116, and 118. This second set of mating walls represents a geometric transformation of the first set of mating walls. FIG. 6D (side view) can be used to understand this transformation. The first set of mating walls 102, 104, 106, 108, 110, and 112 may be mapped onto the second set by mirroring them across mirror plane 119 and then rotating them 180°/n about the vertical linear axis 101.

Figure 6B:
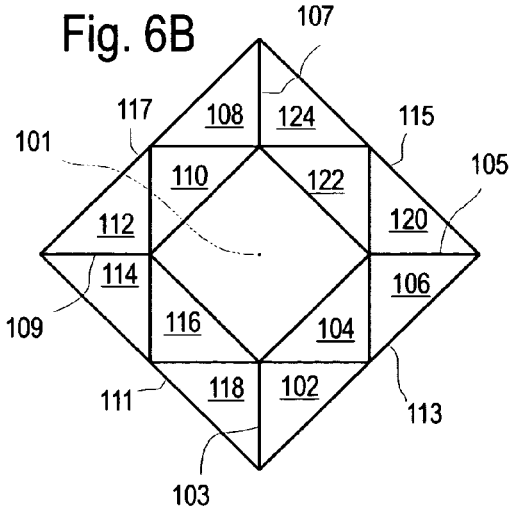
Figure 6C:
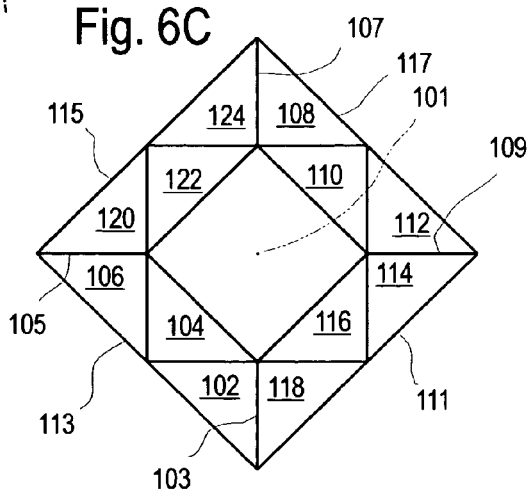
Figure 6D:
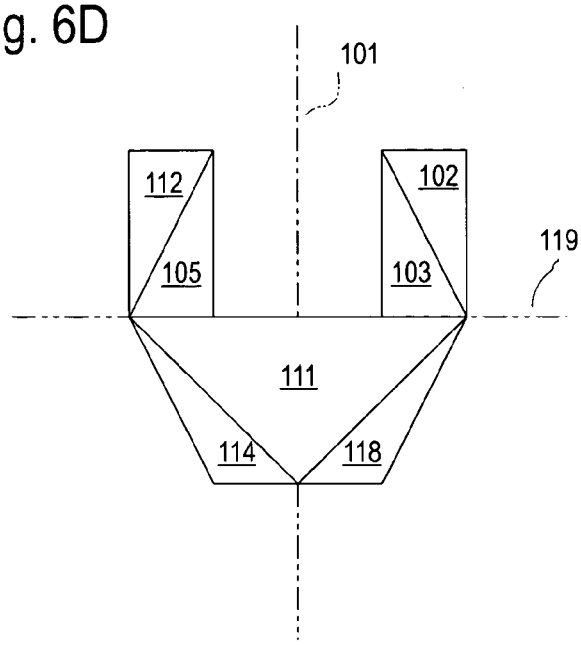

FIGS. 6A-6C also show ancillary walls 103, 105, 107, and 109, as well as cosmetic walls 111, 113, 115, and 117.

Fourth Alternative Embodiment

FIGS. 6E, 8B-8D

Figure 6E:
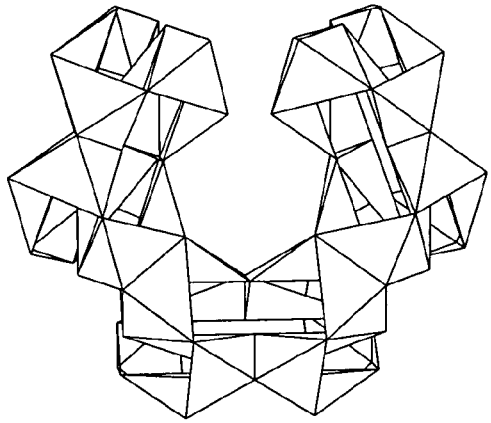
Figure 8A:
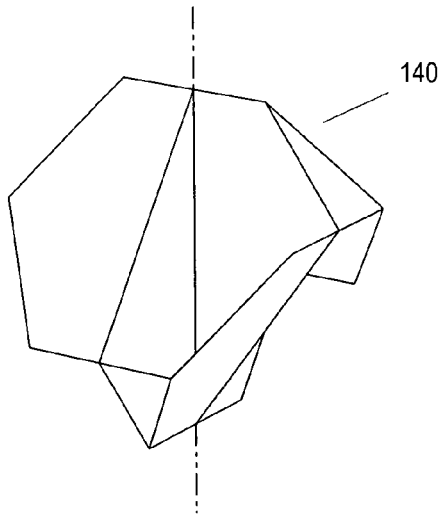
FIG. 8A shows my sixth alternative embodiment.

FIG. 6E shows how a plurality of modules 101 may be mated together, face to face, to build an interesting structure. FIGS. 8B-8D demonstrate this module's ability to mate and fill space with truncated octahedral modules 125 and truncated tetrahedral modules 140.

In either direction along the vertical linear axis, all of the mating walls are visible to an observer. Thus this module is moldable with a straight pull mold whose axis of mold pull parallels the vertical linear axis 101.

Fifth Alternative Embodiment

FIGS. 7A-7C

Figure 7A:
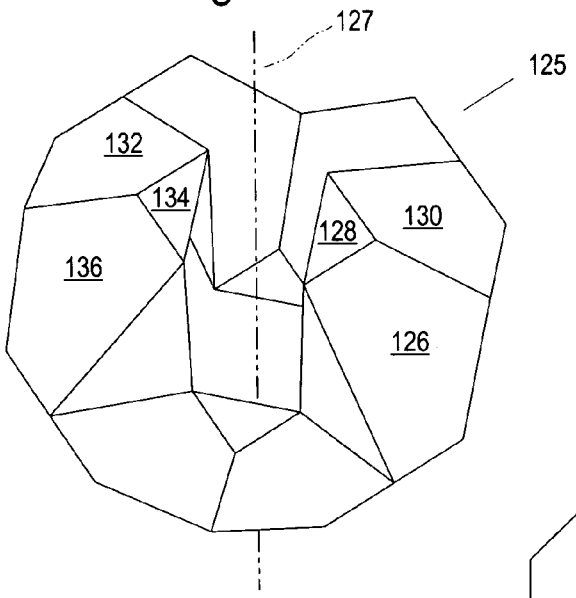
FIGS. 7A-7D show my fifth alternative embodiment.

FIGS. 7A (perspective view), 7B (top view), and 7C (side view) show a module 125 modeled after a truncated octahedral template. The module 125 has $2^{nd}$ order rotational symmetry around a vertical linear axis 127, so n=2 for this module. Module 125 has a first subset of mating walls 126, 128, and 130 and a second subset of mating walls 132, 134, and 136. Mating wall 126 represents a half of a hexagonal face of a truncated octahedron, and mating wall 130 represents a half of another hexagonal face of the same truncated octahedron From the viewpoint of FIG. 7B (along the vertical linear axis 127) it is clear that both subsets fit in a circular sector of 180°/n)(90°).

Figure 7B:
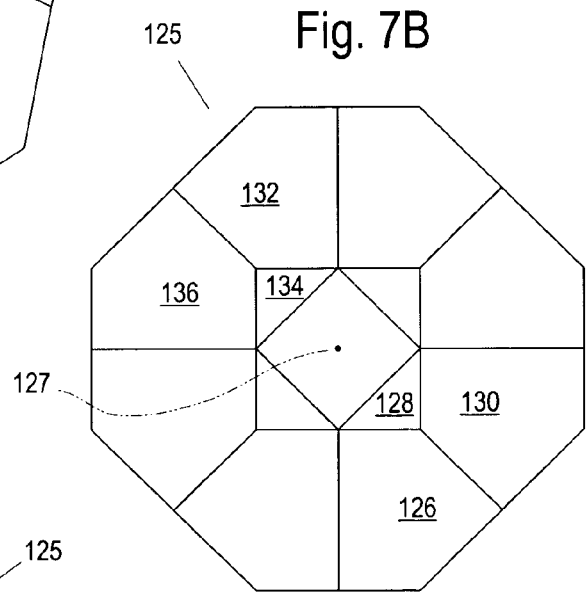
Figure 7C:
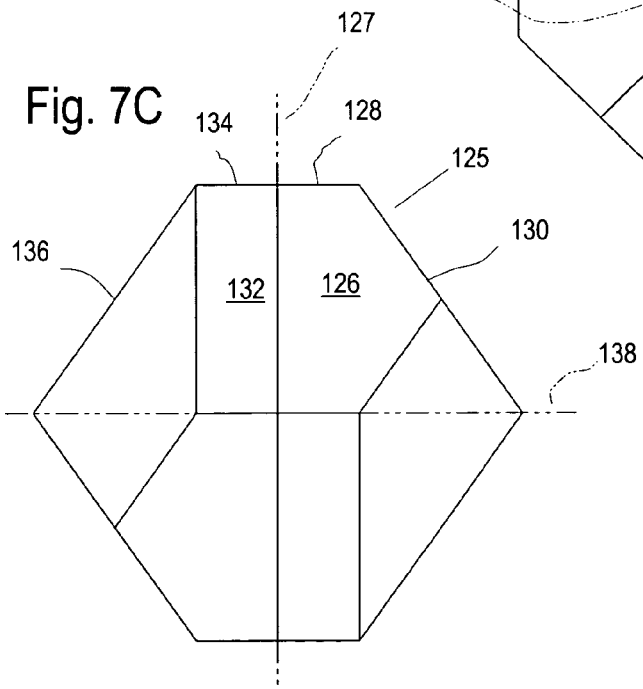

FIG. 7C (side view) shows a mirror plane 138. The entire module can be mapped onto itself by a reflection across mirror plane 138, followed by a 180°/n rotation about the vertical linear axis 127. If a superimposed truncated octahedral template had been shown in this figure, mirror plane 138 would have passed through its vertical midpoint.

Fifth Alternative Embodiment

FIGS. 7A-7D, 8B-8D

FIGS. 7A-7C demonstrate that module 125 is free of undercuts and can therefore be molded with a straight pull mold whose axis of mold pull is parallel to the vertical linear axis 127. In either direction along the vertical linear axis, all of the mating walls are visible to an observer.

Figure 7D:
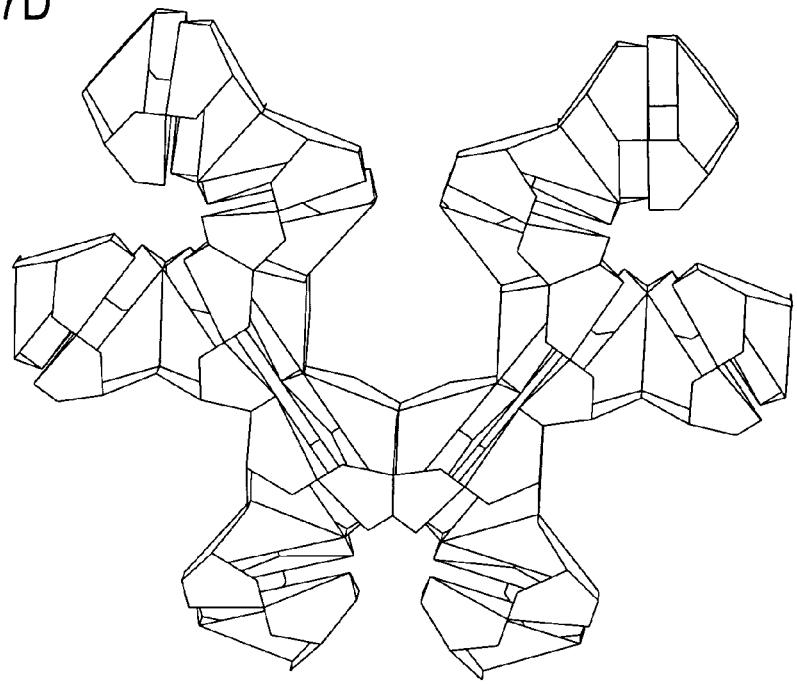

FIG. 7D demonstrates the ability of a plurality of these modules to connect together, face to face. FIGS. 8B-8D demonstrate this module's ability to mate with and fill space with cubooctahedral modules 101 and truncated tetrahedral modules 140.

Sixth Alternative Embodiment

FIGS. 8A-8D

Module 140 is modeled after a regular truncated tetrahedron. It is similar to the truncated isosceles tetrahedral module 84 shown in FIG. 5H. While regular truncated tetrahedra do not fill space on their own, they do fill space in concert with regular truncated octahedra and cubooctahedra. FIGS. 8B-8D demonstrate this module's ability to mate and fill space with cubooctahedral modules 101 and truncated octahedral modules 125.

Seventh Alternative Embodiment

FIGS. 9A-9C

Figure 9A:
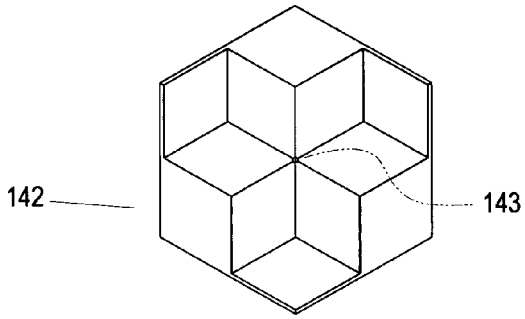
FIGS. 9A-9C show my seventh alternative embodiment.
Figure 9B:
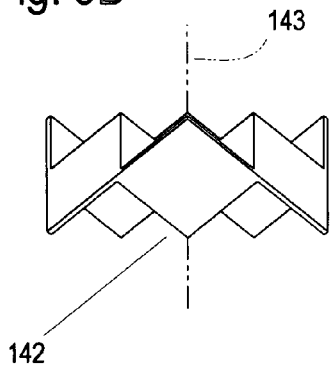
Figure 9C:
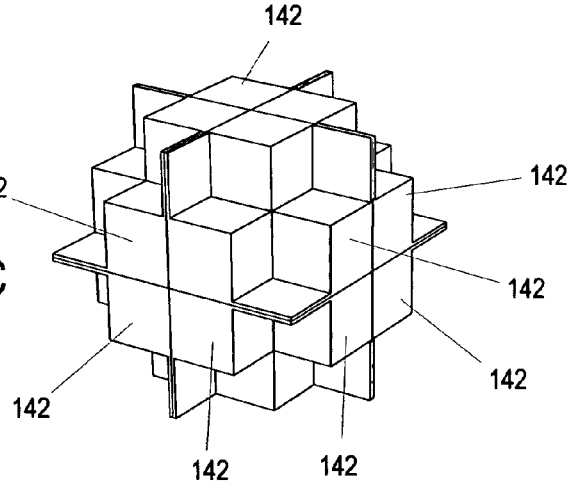

FIG. 9A is a top view of module 142. FIG. 9B is a side view. Its vertical linear axis 143 is shown in both figures. FIG. 9C shows eight modules 142 mated together.

Eighth Alternative Embodiment

FIGS. 9D-9E

Figure 9D:
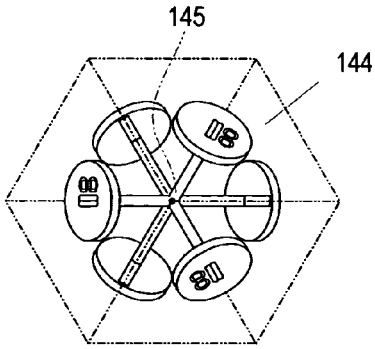
FIGS. 9D and 9E show my eighth alternative embodiment.
Figure 9E:
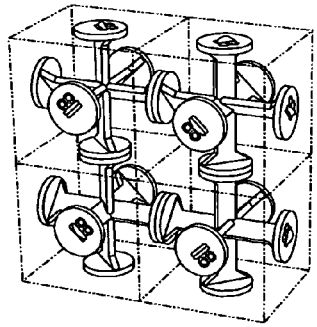

FIG. 9D shows a module 144 with mating walls coplanar with a superimposed cube. The module's vertical linear axis 145 is indicated. FIG. 9E shows multiple versions of module 144 mated together.

Ninth Alternative Embodiment

FIGS. 9F-9G

Figure 9F:
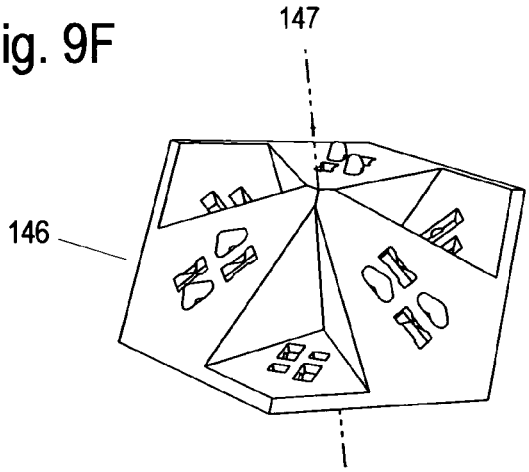
FIGS. 9F and 9G show my ninth alternative embodiment.
Figure 9G:
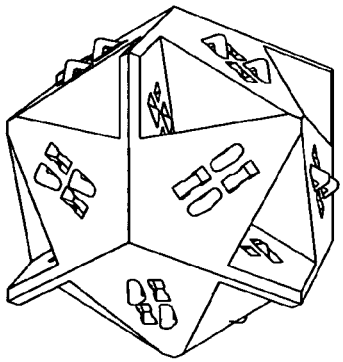

FIG. 9F shows a module 146. The module's vertical linear axis 147 is indicated. FIG. 9G shows four modules 146 mated together.

CONCLUSION, RAMIFICATIONS, AND SCOPE

Thus the reader will see that the construction modules of this invention represent a combination of advantages unprecedented in the prior art. Each module may be straight pull molded as a single piece of material while retaining the face-to-face construction properties of a polyhedron. Accordingly, most of my modules may be intuitively mated to compatible modules occupying any or all of the adjacent cells of a geometric honeycomb. For my cube-derived embodiments, this means my modules can be built outward in any of six directions; up, down, left, right, back, and forth. For embodiments derived from an isosceles tetrahedron, this means building outward in four directions. In this way, my construction modules can substantially fill space and extend into space in three dimensions. Furthermore, my construction modules have additional advantages in that

- they function as polyhedra, any face of which can be mated to at least half of its identically-shaped faces on another identical polyhedron.
- my invention is not limited to the embodiments shown here; it is a method of creating an unlimited number of interesting modules with a variety of characteristics.
- they may be manufactured with an economical straight-pull injection mold.
- any of my modules can be designed with injection moldable snap-fit connectors, thus rendering all of their mating configurations secure but releasable.
- compared to most construction modules, many of my modules' embodiments represent novel geometries, and their connections space-filling characteristics are therefore surprising, interesting, and challenging.
- each of my modules can be designed to accept snap-fit accessories, such as eyes, on numerous surfaces.
- my modules can serve as fascinating math-teaching manipulatives that are useful for teaching symmetry and tessellation concepts.
- they may be manufactured at a number of scales, allowing them to satisfy a broad variety of aesthetic, functional, and safety criteria.
- my modules' connectors may be made compatible so that several embodiments of my modules might be sold together as a construction system of connectably compatible modules with a variety of geometric characteristics.

While my above description contains many specificities, these should not be construed as limitations on the scope of the invention, but rather as an exemplification of one preferred embodiment thereof. Many other variations are possible. For example,

- Variations of my construction modules may have different wall thicknesses.
- My construction modules may have rounded edges and corners, rather than the sharp edges and corners shown in this document.
- My modules surfaces may be carved away or added to in many different ways, either cosmetic, utilitarian, or both.
- For any one polyhedron template, many module variations may be created, comprising polyhedron wall portions of varying sizes, shapes, and origins.
- My modules may be made in a variety of sizes and colors—or in no color at all.
- My modules may be made in a variety of plastic and non-plastic materials, such as plastic, wood, or metal.
- My modules designs may be derived from a variety of polyhedron templates, including but not limited to the following geometries: cuboidal, regular tetrahedral, isosceles tetrahedral, regular octahedral, isosceles octahedral, truncated isosceles tetrahedral, truncated regular tetrahedral, truncated isosceles octahedral, truncated regular octahedral, cubooctahedral, brick-shaped, rhombus-shaped, and rhombic hexahedral.
- My modules can be made with snap-fit or press fit connectors—or no connectors at all.
- My modules can incorporate male and female connectors arranged in a variety of configurations.
- The manner in which mating walls of my modules are connected together can vary; for instance, they can be connected with ribs, struts, portions of a spherical shell, or any type of ancillary wall. They may also simply connect at one or more of their edges, surfaces, or corners.
- My modules may be used in sets of identical modules, or they may be used in sets of varied, but compatible, modules.
- My modules may be used as toys or for other construction purposes.
- My modules may be used whole or in part.

Thus the scope of the invention should be determined not by the embodiments illustrated, but by the appended claims and their legal equivalents.

I claim:

1. A construction module, comprising:

(a) a vertical linear axis (b) a plurality of planar walls, said plurality of planar walls comprising a first set and a second set of planar walls;

(c) said first set of planar walls, having n-order rotational symmetry about said vertical linear axis and comprising n identical subsets, n being greater than one;

(d) said identical subsets, each comprising a planar wall inclined obliquely to said vertical linear axis, being a 360°/n rotation of another said identical subset about said vertical linear axis, and, when viewed along said vertical linear axis, occupying a circular sector around said vertical linear axis no greater than 180°/n;

(e) said second set of planar walls, being mappable onto said first set of planar walls by reflection across a horizontal mirror plane followed by a 180°/n rotation about said vertical linear axis;

(f) said first and second sets of planar walls, every portion of each being noncollinear with every other portion of said construction module, said noncollinearity existing along vertical lines; and whereby a planar wall of one said construction module may be abutted, face to face, with a mirror image planar wall of another identical module, and whereby said construction module may be molded in one piece with a straight pull mold whose axis of mold pull parallels said vertical linear axis.

2. The construction module of claim 1 wherein said construction module consists of one piece of molded material.

3. The construction module of claim 1 wherein each wall of said first set of planar walls lies coplanar with a surface of a polyhedral template, said polyhedral template being space-filling.

4. The construction module of claim 3 wherein each wall of said second set of planar walls lies coplanar with a surface of said polyhedral template.

5. The construction module of claim 4 wherein said polyhedral template is an isosceles tetrahedral template, said polyhedral template having four identical isosceles triangular faces with vertex angles of 70.53 degrees and 54.7 degrees, wherein said vertical linear axis passes through the midpoints of the two long edges of said polyhedral template, and wherein said horizontal mirror plane passes through the midpoints of the legs of said isosceles triangular faces.

6. The construction module of claim 5 wherein said subset comprises one right triangular planar wall, said right triangular planar wall being one of two congruent halves of a said isosceles triangular face.

7. The construction module of claim 5 wherein said subset comprises one substantially right triangular planar wall, said substantially right triangular planar wall being, substantially, one of two congruent halves of a said isosceles triangular face.

8. A construction module, comprising:

(a) a vertical linear axis (b) a first set of n identical planar walls having collective n-order rotational symmetry about said vertical linear axis;

(c) said planar walls, each inclined obliquely to said vertical linear axis, and when viewed along said vertical linear axis, occupying a circular sector around said vertical linear axis, said circular sector being no greater than 180°/n;

(d) a second set of planar walls, being a compound transformation of said first set of planar walls, said compound transformation consisting of a reflection across a horizontal mirror plane followed by a 180°/n rotation about said vertical linear axis;

(e) said first and second sets of planar walls, every portion of each being noncollinear with every other portion of said construction module, said noncollinearity existing along vertical lines; and whereby a planar wall of one said construction module may be abutted, face to face, with a mirror image planar wall of another identical module, and whereby said construction module may be molded in one piece with a straight pull mold whose axis of mold pull parallels said vertical linear axis.

* * * * *